US008105149B2

(12) United States Patent
DeWaal

(10) Patent No.: US 8,105,149 B2
(45) Date of Patent: Jan. 31, 2012

(54) GAMING SYSTEM AND METHOD PROVIDING VENUE WIDE SIMULTANEOUS PLAYER PARTICIPATION BASED BONUS GAME

(75) Inventor: Daniel DeWaal, Las Vegas, NV (US)

(73) Assignee: IGT, Reno, NV (US)

( * ) Notice: Subject to any disclaimer, the term of this patent is extended or adjusted under 35 U.S.C. 154(b) by 1210 days.

(21) Appl. No.: 11/558,683

(22) Filed: Nov. 10, 2006

(65) Prior Publication Data

US 2008/0113765 A1 May 15, 2008

(51) Int. Cl.
*A63F 9/24* (2006.01)

(52) U.S. Cl. ..... 463/20

(58) Field of Classification Search ..... None
See application file for complete search history.

(56) References Cited

U.S. PATENT DOCUMENTS

| | | | |
|---|---|---|---|
| 1,978,395 | A | 10/1934 | Groetchen |
| 2,545,644 | A | 3/1951 | Benton et al. |
| 2,743,108 | A | 4/1956 | Sanders |
| 2,942,574 | A | 6/1960 | Golay |
| 3,420,525 | A | 1/1969 | Waders |
| 3,618,019 | A | 11/1971 | Nemirovsky et al. |
| 3,642,287 | A | 2/1972 | Lally et al. |
| 3,735,987 | A | 5/1973 | Ohki |
| 3,904,207 | A | 9/1975 | Gold |
| 3,971,557 | A | 7/1976 | Breslow et al. |
| 3,975,022 | A | 8/1976 | Figueroa |
| 3,998,309 | A | 12/1976 | Mandas et al. |
| 4,072,930 | A | 2/1978 | Lucero et al. |
| 4,182,515 | A | 1/1980 | Nemeth |
| 4,198,052 | A | 4/1980 | Gauselmann |
| 4,238,127 | A | 12/1980 | Lucero et al. |
| 4,277,064 | A | 7/1981 | Newman |
| 4,283,709 | A | 8/1981 | Lucero et al. |
| 4,335,809 | A | 6/1982 | Wain |
| 4,339,798 | A | 7/1982 | Hedges et al. |

(Continued)

FOREIGN PATENT DOCUMENTS

AU 524709 9/1982

(Continued)

OTHER PUBLICATIONS

4DU Dice Unit Advertisement written by starpoint.uk.com, printed on Sep. 3, 2002.

(Continued)

*Primary Examiner* — Corbett B Coburn
(74) *Attorney, Agent, or Firm* — K&L Gates LLP

(57) ABSTRACT

In one embodiment, the gaming system and method disclosed herein substantially simultaneously provides a multi-round bonus event to a plurality of players. Each players' input(s) determine, at least in part, an award, if any, provided to that player for the bonus event. In one embodiment, upon an occurrence of a suitable triggering event, a central controller of the gaming system identifies at least one player and preferably a plurality of players who are eligible for the bonus event. The central controller causes the bonus event to be provided to those eligible players. In one such embodiment, the bonus event enables one or more eligible players in the gaming system to simultaneously (or substantially simultaneously) attempt to win the award in the bonus event. In this embodiment, the outcome of the bonus event is determined, at least in part, by one or more player inputs, choices or decisions in the bonus event.

36 Claims, 20 Drawing Sheets

TOTAL AWARD: $100,000

| ROUND | ELIGIBLE PLAYERS | ADVANCING PLAYERS | AWARD WON PER ADVANCING PLAYER PER ROUND |
|---|---|---|---|
| 1 | 800 | 400 | $2 |
| 2 | 400 | 200 | $10 |
| 3 | 200 | 100 | $50 |
| 4 | 100 | 25 | $300 |
| 5 | 25 | 5 | $20,200 |
| 6 | 5 | 0 | $0 |

Award Provided to the Five Players Who Advanced to Round 5 Because Zero Players Advance in Round 5.

U.S. PATENT DOCUMENTS

| | | | |
|---|---|---|---|
| 4,363,485 | A | 12/1982 | Edwall |
| 4,409,656 | A | 10/1983 | Andersen et al. |
| 4,410,178 | A | 10/1983 | Partridge |
| 4,448,419 | A | 5/1984 | Telnaes |
| 4,494,197 | A | 1/1985 | Troy et al. |
| 4,560,161 | A | 12/1985 | Hamano |
| 4,573,681 | A | 3/1986 | Okada |
| 4,582,324 | A | 4/1986 | Koza et al. |
| 4,618,150 | A | 10/1986 | Kimura |
| 4,621,814 | A | 11/1986 | Stepan et al. |
| 4,624,459 | A | 11/1986 | Kaufman |
| 4,636,951 | A | 1/1987 | Harlick |
| 4,652,998 | A | 3/1987 | Koza et al. |
| 4,669,731 | A | 6/1987 | Clarke |
| 4,679,143 | A | 7/1987 | Hagiwara |
| 4,695,053 | A | 9/1987 | Vazquez, Jr. et al. |
| 4,721,307 | A | 1/1988 | Okada |
| 4,732,386 | A | 3/1988 | Rayfiel |
| 4,743,024 | A | 5/1988 | Helm et al. |
| 4,756,531 | A | 7/1988 | DiRe et al. |
| 4,760,527 | A | 7/1988 | Sidley |
| 4,775,155 | A | 10/1988 | Lees |
| 4,805,907 | A | 2/1989 | Hagiwara |
| 4,817,951 | A | 4/1989 | Crouch et al. |
| 4,836,546 | A | 6/1989 | DiRe et al. |
| 4,837,728 | A | 6/1989 | Barrie et al. |
| 4,838,552 | A | 6/1989 | Hagiwara |
| 4,842,278 | A | 6/1989 | Markowicz |
| 4,844,464 | A | 7/1989 | Berge |
| 4,856,787 | A | 8/1989 | Itkis |
| 4,871,171 | A | 10/1989 | Rivero |
| 4,880,237 | A | 11/1989 | Kishishita |
| 4,926,327 | A | 5/1990 | Sidley |
| 4,964,638 | A | 10/1990 | Ishida |
| 4,991,848 | A | 2/1991 | Greenwood et al. |
| 5,019,973 | A | 5/1991 | Wilcox et al. |
| 5,033,744 | A | 7/1991 | Bridgeman et al. |
| 5,038,022 | A | 8/1991 | Lucero |
| 5,046,737 | A | 9/1991 | Fienberg |
| 5,048,833 | A | 9/1991 | Lamle |
| 5,058,893 | A | 10/1991 | Dickinson et al. |
| 5,074,559 | A | 12/1991 | Okada |
| 5,083,271 | A | 1/1992 | Thacher et al. |
| 5,092,598 | A | 3/1992 | Kamille |
| 5,116,055 | A | 5/1992 | Tracy |
| 5,123,649 | A | 6/1992 | Tiberio |
| 5,127,651 | A | 7/1992 | Okada |
| 5,152,529 | A | 10/1992 | Okada |
| 5,158,293 | A | 10/1992 | Mullins |
| 5,178,390 | A | 1/1993 | Okada |
| 5,186,460 | A | 2/1993 | Fongeallaz et al. |
| 5,205,555 | A | 4/1993 | Hamano |
| 5,209,479 | A | 5/1993 | Nagao |
| 5,217,224 | A | 6/1993 | Sincock |
| 5,242,163 | A | 9/1993 | Fulton |
| 5,249,800 | A | 10/1993 | Hilgendorf et al. |
| 5,259,616 | A | 11/1993 | Bergmann |
| 5,265,874 | A | 11/1993 | Dickinson et al. |
| 5,275,400 | A | 1/1994 | Weingardt |
| 5,276,312 | A | 1/1994 | McCarthy |
| 5,277,424 | A | 1/1994 | Wilms |
| 5,280,909 | A | 1/1994 | Tracy |
| 5,286,023 | A | 2/1994 | Wood |
| 5,288,081 | A | 2/1994 | Breeding |
| 5,290,033 | A | 3/1994 | Bittner et al. |
| 5,292,127 | A | 3/1994 | Kelly et al. |
| 5,308,065 | A | 5/1994 | Bridgeman et al. |
| 5,321,241 | A | 6/1994 | Craine |
| 5,324,035 | A | 6/1994 | Morris et al. |
| 5,326,104 | A | 7/1994 | Pease et al. |
| 5,332,228 | A | 7/1994 | Schultz |
| 5,342,047 | A | 8/1994 | Heidel et al. |
| 5,342,049 | A | 8/1994 | Wichinsky et al. |
| 5,344,144 | A | 9/1994 | Canon |
| 5,351,970 | A | 10/1994 | Fioretti |
| 5,364,100 | A | 11/1994 | Ludlow et al. |
| 5,377,993 | A | 1/1995 | Josephs |
| 5,380,007 | A | 1/1995 | Travis et al. |
| 5,393,057 | A | 2/1995 | Marnell, II |
| 5,393,061 | A | 2/1995 | Manship et al. |
| 5,395,111 | A | 3/1995 | Inoue |
| 5,397,125 | A | 3/1995 | Adams |
| 5,398,932 | A | 3/1995 | Eberhardt et al. |
| 5,401,024 | A | 3/1995 | Simunek |
| 5,407,200 | A | 4/1995 | Zalabak |
| 5,411,271 | A | 5/1995 | Mirando |
| 5,417,430 | A | 5/1995 | Breeding |
| 5,423,539 | A | 6/1995 | Nagao |
| 5,429,361 | A | 7/1995 | Raven et al. |
| 5,431,408 | A | 7/1995 | Adams |
| 5,449,173 | A | 9/1995 | Thomas et al. |
| 5,456,465 | A | 10/1995 | Durham |
| 5,470,079 | A | 11/1995 | LeStrange et al. |
| 5,472,194 | A | 12/1995 | Breeding et al. |
| 5,472,197 | A | 12/1995 | Gwiasda et al. |
| 5,476,259 | A | 12/1995 | Weingardt |
| 5,489,101 | A | 2/1996 | Moody |
| 5,511,781 | A | 4/1996 | Wood |
| 5,524,888 | A | 6/1996 | Heidel |
| 5,531,441 | A | 7/1996 | Dabrowski et al. |
| 5,536,016 | A | 7/1996 | Thompson |
| 5,542,669 | A | 8/1996 | Charron et al. |
| 5,544,892 | A | 8/1996 | Breeding |
| 5,544,893 | A | 8/1996 | Jones et al. |
| 5,547,192 | A | 8/1996 | Ishibashi |
| 5,560,603 | A | 10/1996 | Seelig et al. |
| 5,564,700 | A | 10/1996 | Celona |
| 5,564,701 | A | 10/1996 | Dettor |
| 5,566,337 | A | 10/1996 | Szymanski et al. |
| 5,570,885 | A | 11/1996 | Ornstein |
| 5,580,053 | A | 12/1996 | Crouch |
| 5,580,309 | A | 12/1996 | Piechowiak et al. |
| 5,584,485 | A | 12/1996 | Jone et al. |
| 5,584,763 | A | 12/1996 | Kelly et al. |
| 5,584,764 | A | 12/1996 | Inoue |
| 5,601,487 | A | 2/1997 | Oshima et al. |
| 5,605,506 | A | 2/1997 | Hoorn et al. |
| 5,609,524 | A | 3/1997 | Inoue |
| 5,611,535 | A | 3/1997 | Tiberio |
| 5,611,730 | A | 3/1997 | Weiss |
| 5,622,366 | A | 4/1997 | Inoue |
| 5,626,341 | A | 5/1997 | Jones |
| 5,639,089 | A | 6/1997 | Matsumoto et al. |
| 5,641,050 | A | 6/1997 | Smith et al. |
| 5,641,730 | A | 6/1997 | Brown |
| 5,645,486 | A | 7/1997 | Nagao et al. |
| 5,647,798 | A | 7/1997 | Falciglia |
| 5,655,961 | A | 8/1997 | Acres et al. |
| 5,664,998 | A | 9/1997 | Seelig et al. |
| 5,674,128 | A | 10/1997 | Holch et al. |
| 5,702,304 | A | 12/1997 | Acres et al. |
| 5,707,285 | A | 1/1998 | Place et al. |
| 5,707,286 | A | 1/1998 | Carlson |
| 5,711,525 | A | 1/1998 | Breeding |
| 5,720,483 | A | 2/1998 | Trinh |
| 5,722,891 | A | 3/1998 | Inoue |
| 5,732,948 | A | 3/1998 | Yoseloff |
| 5,741,183 | A | 4/1998 | Acres et al. |
| 5,743,523 | A | 4/1998 | Kelly et al. |
| 5,743,524 | A | 4/1998 | Nannicola |
| 5,743,526 | A | 4/1998 | Inoue |
| 5,743,800 | A | 4/1998 | Huard et al. |
| 5,752,881 | A | 5/1998 | Inoue |
| 5,752,882 | A | 5/1998 | Acres et al. |
| 5,755,619 | A | 5/1998 | Matsumoto et al. |
| 5,755,621 | A | 5/1998 | Marks et al. |
| 5,758,875 | A | 6/1998 | Giacalone, Jr. |
| 5,761,647 | A | 6/1998 | Boushy |
| 5,762,552 | A | 6/1998 | Vuong |
| 5,766,076 | A | 6/1998 | Pease et al. |
| 5,769,716 | A | 6/1998 | Saffari et al. |
| 5,772,506 | A | 6/1998 | Marks et al. |
| 5,772,509 | A | 6/1998 | Weiss |
| 5,772,511 | A | 6/1998 | Smeltzer |
| RE35,864 | E | 7/1998 | Weingardt |
| 5,775,692 | A | 7/1998 | Watts et al. |
| 5,779,242 | A | 7/1998 | Kaufmann |

5,779,544 A 7/1998 Seelig et al.
5,779,545 A 7/1998 Berg et al.
5,779,547 A 7/1998 SoRelle et al.
5,779,549 A 7/1998 Walker et al.
5,788,573 A 8/1998 Baerlocher et al.
5,800,269 A 9/1998 Holch et al.
5,806,045 A 9/1998 Biorge et al.
5,806,855 A 9/1998 Cherry
5,807,172 A 9/1998 Piechowiak
5,816,918 A 10/1998 Kelly et al.
5,820,459 A 10/1998 Acres et al.
5,820,460 A 10/1998 Fulton
5,823,872 A 10/1998 Prather et al.
5,823,873 A 10/1998 Moody
5,823,874 A 10/1998 Adams
5,823,879 A 10/1998 Goldberg et al.
D400,597 S 11/1998 Hedrick et al.
5,833,536 A 11/1998 Davids et al.
5,833,537 A 11/1998 Barrie
5,833,538 A 11/1998 Weiss
5,833,540 A 11/1998 Miodunski et al.
5,836,817 A 11/1998 Acres et al.
D402,702 S 12/1998 Seelig et al.
5,846,132 A 12/1998 Junkin
5,848,932 A 12/1998 Adams
5,851,011 A 12/1998 Lott
5,851,148 A 12/1998 Brune et al.
5,851,149 A 12/1998 Xidos et al.
D404,436 S 1/1999 McGahn et al.
5,855,514 A * 1/1999 Kamille ..... 463/17
5,855,515 A 1/1999 Pease et al.
5,863,249 A 1/1999 Inoue
5,873,781 A 2/1999 Keane
D406,865 S 3/1999 Heidel
5,876,284 A 3/1999 Acres et al.
5,882,261 A 3/1999 Adams
5,885,157 A 3/1999 Harada et al.
5,885,158 A 3/1999 Torango et al.
5,890,962 A 4/1999 Takemoto
5,893,718 A 4/1999 O'Donnell
5,902,184 A 5/1999 Bennett
5,902,983 A 5/1999 Crevelt et al.
5,910,048 A 6/1999 Feinberg
5,911,418 A 6/1999 Adams et al.
5,917,725 A 6/1999 Thacher et al.
5,919,088 A 7/1999 Weiss
5,924,927 A 7/1999 Matsuura et al.
5,927,714 A 7/1999 Kaplan
5,934,672 A 8/1999 Sines et al.
5,935,000 A 8/1999 Sanchez, III et al.
5,935,002 A 8/1999 Falciglia
5,941,772 A 8/1999 Paige
5,941,773 A 8/1999 Harlick
5,944,606 A 8/1999 Gerow
5,947,820 A 9/1999 Morro et al.
5,947,822 A 9/1999 Weiss
5,951,011 A 9/1999 Potter et al.
5,951,397 A 9/1999 Dickinson
5,964,463 A 10/1999 Moore, Jr.
5,967,894 A 10/1999 Kinoshita et al.
5,976,015 A 11/1999 Seelig et al.
5,976,016 A 11/1999 Moody et al.
5,980,384 A 11/1999 Barrie
5,984,779 A 11/1999 Bridgeman et al.
5,984,781 A 11/1999 Sunaga
5,984,782 A 11/1999 Inoue
5,989,121 A 11/1999 Sakamoto
5,993,316 A 11/1999 Coyle et al.
5,997,400 A 12/1999 Seelig et al.
5,997,401 A 12/1999 Crawford
6,001,016 A 12/1999 Walker et al.
6,004,207 A 12/1999 Wilson, Jr. et al.
6,007,066 A 12/1999 Moody
6,007,427 A 12/1999 Wiener
6,012,982 A 1/2000 Piechowiak et al.
6,012,983 A 1/2000 Walker et al.
6,015,344 A 1/2000 Kelly et al.
6,015,346 A 1/2000 Bennett
6,016,338 A 1/2000 Bansal et al.
6,019,369 A 2/2000 Nakagawa et al.
6,019,374 A 2/2000 Breeding
6,033,307 A 3/2000 Vancura
6,039,648 A 3/2000 Guinn et al.
6,039,649 A 3/2000 Schulze
6,045,129 A 4/2000 Cooper et al.
6,047,963 A 4/2000 Pierce et al.
6,048,269 A 4/2000 Burns et al.
6,050,895 A 4/2000 Luciano et al.
6,056,642 A 5/2000 Bennett
6,059,289 A 5/2000 Vancura
6,059,658 A 5/2000 Mangano et al.
6,062,979 A 5/2000 Inoue
6,062,980 A 5/2000 Luciano
6,062,981 A 5/2000 Luciano, Jr.
6,068,553 A 5/2000 Parker
6,077,162 A 6/2000 Weiss
6,080,062 A 6/2000 Olson
6,082,887 A 7/2000 Feuer et al.
6,086,066 A 7/2000 Takeuchi et al.
6,089,975 A 7/2000 Dunn
6,089,976 A 7/2000 Schneider et al.
6,089,977 A 7/2000 Bennett
6,089,978 A 7/2000 Adams
6,089,980 A 7/2000 Gauselmann
6,093,102 A 7/2000 Bennett
6,099,408 A 8/2000 Schneier et al.
6,102,400 A 8/2000 Scott et al.
6,102,798 A 8/2000 Bennett
6,105,962 A 8/2000 Malavazos et al.
6,110,039 A 8/2000 Oh
6,110,041 A 8/2000 Walker et al.
6,110,043 A 8/2000 Olsen
6,113,098 A 9/2000 Adams
6,117,009 A 9/2000 Yoseloff
6,117,013 A 9/2000 Eiba
6,120,031 A 9/2000 Adams
6,120,377 A 9/2000 McGinnis, Sr. et al.
6,120,378 A 9/2000 Moody et al.
6,126,541 A 10/2000 Fuchs
6,126,542 A 10/2000 Fier
6,128,550 A 10/2000 Heidel et al.
6,129,355 A 10/2000 Hahn et al.
6,135,884 A 10/2000 Hedrick et al.
6,135,885 A 10/2000 Lermusiaux
6,139,013 A 10/2000 Pierce et al.
6,141,409 A 10/2000 Madoch et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,146,273 A 11/2000 Olsen
6,149,156 A 11/2000 Feola
6,149,157 A 11/2000 Suan
6,149,521 A 11/2000 Sanduski
6,152,823 A 11/2000 Lacoste et al.
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,162,122 A 12/2000 Acres et al.
6,165,070 A 12/2000 Nolte et al.
6,165,071 A 12/2000 Weiss
6,165,072 A 12/2000 Davis et al.
6,168,520 B1 1/2001 Baerlocher et al.
6,168,521 B1 1/2001 Luciano et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,183,366 B1 2/2001 Goldberg et al.
6,186,893 B1 2/2001 Walker et al.
6,186,894 B1 2/2001 Mayeroff
6,190,254 B1 2/2001 Bennett
6,190,255 B1 2/2001 Thomas et al.
6,193,606 B1 2/2001 Walker et al.
6,193,610 B1 2/2001 Junkin 6,203,010 B1 3/2001 Jorasch et al.
6,203,429 B1 3/2001 Demar et al.
6,203,430 B1 3/2001 Walker et al.
6,206,374 B1 3/2001 Jones
6,206,782 B1 3/2001 Walker et al.
D441,031 S 4/2001 Seelig et al.
6,210,275 B1 * 4/2001 Olsen ..... 463/16
6,210,277 B1 4/2001 Stefan
6,210,279 B1 4/2001 Dickinson
6,213,876 B1 4/2001 Moore, Jr.
6,217,448 B1 4/2001 Olsen
6,220,593 B1 4/2001 Pierce et al.
6,220,959 B1 4/2001 Holmes, Jr. et al.
6,220,961 B1 4/2001 Keane et al.
6,224,482 B1 5/2001 Bennett
6,224,483 B1 5/2001 Mayeroff
6,224,484 B1 5/2001 Okuda et al.
6,224,486 B1 5/2001 Walker et al.
6,227,970 B1 5/2001 Shimizu et al.
6,227,971 B1 5/2001 Weiss
6,231,442 B1 5/2001 Mayeroff
6,231,445 B1 5/2001 Acres
6,234,879 B1 5/2001 Hasegawa et al.
6,234,897 B1 5/2001 Frohm et al.
6,238,287 B1 5/2001 Komori et al.
6,238,288 B1 5/2001 Walker et al.
D443,313 S 6/2001 Brettschneider
6,241,608 B1 6/2001 Torango
6,244,958 B1 6/2001 Acres
6,251,013 B1 6/2001 Bennett
6,254,481 B1 7/2001 Jaffe
6,254,483 B1 7/2001 Acres
6,257,981 B1 7/2001 Acres et al.
6,261,128 B1 7/2001 Heim et al.
6,261,177 B1 7/2001 Bennett
6,264,557 B1 7/2001 Schneier et al.
6,267,669 B1 7/2001 Luciano, Jr. et al.
6,270,409 B1 8/2001 Shuster
6,270,411 B1 8/2001 Gura et al.
6,270,412 B1 8/2001 Crawford et al.
6,287,202 B1 9/2001 Pascal et al.
6,293,866 B1 9/2001 Walker et al.
RE37,414 E 10/2001 Harlick
6,299,165 B1 10/2001 Nagano
6,299,170 B1 10/2001 Yoseloff
6,302,398 B1 10/2001 Vecchio
6,302,790 B1 10/2001 Brossard
6,302,793 B1 10/2001 Fertitta, III et al.
6,305,686 B1 10/2001 Perrie et al.
6,309,298 B1 10/2001 Gerow
6,309,299 B1 10/2001 Weiss
6,309,300 B1 10/2001 Glavich
6,309,307 B1 10/2001 Krause et al.
6,311,976 B1 11/2001 Yoseloff et al.
6,312,330 B1 11/2001 Jones et al.
6,312,333 B1 11/2001 Acres
6,312,334 B1 11/2001 Yoseloff
6,315,660 B1 11/2001 DeMar et al.
6,315,662 B1 11/2001 Jorasch et al.
6,315,663 B1 11/2001 Sakamoto
6,315,664 B1 11/2001 Baerlocher et al.
6,319,122 B1 11/2001 Packes, Jr. et al.
6,319,123 B1 11/2001 Paludi
6,319,124 B1 11/2001 Baerlocher et al.
6,319,125 B1 11/2001 Acres
6,322,078 B1 11/2001 Adams
6,322,309 B1 11/2001 Thomas et al.
6,328,649 B1 12/2001 Randall et al.
6,334,814 B1 1/2002 Adams
6,336,857 B1 1/2002 McBride
6,336,860 B1 1/2002 Webb
6,336,863 B1 1/2002 Baerlocher et al.
6,338,678 B1 1/2002 Seelig et al.
6,340,158 B2 1/2002 Pierce et al.
6,343,989 B1 2/2002 Wood et al.
6,346,043 B1 2/2002 Colin et al.
6,347,738 B1 2/2002 Crevelt et al.
6,347,996 B1 2/2002 Gilmore et al.
6,358,144 B1 3/2002 Kadlic et al.
6,358,149 B1 3/2002 Schneider et al.
6,361,441 B1 3/2002 Walker et al.
6,364,765 B1 4/2002 Walker et al.
6,364,766 B1 4/2002 Anderson et al.
6,364,767 B1 4/2002 Brossard et al.
6,364,768 B1 4/2002 Acres et al.
6,364,769 B1 4/2002 Weiss et al.
6,368,216 B1 4/2002 Hedrick et al.
6,368,218 B2 4/2002 Angell, Jr.
6,371,852 B1 4/2002 Acres
6,375,187 B1 4/2002 Baerlocher et al.
6,375,567 B1 4/2002 Acres
6,375,568 B1 4/2002 Roffman et al.
6,375,569 B1 4/2002 Acres
6,375,570 B1 4/2002 Poole
6,386,974 B1 5/2002 Adams
6,386,977 B1 5/2002 Hole
6,398,218 B1 6/2002 Vancura
6,398,220 B1 6/2002 Inoue
6,398,644 B1 6/2002 Perrie et al.
6,398,645 B1 6/2002 Yoseloff
6,406,369 B1 6/2002 Baerlocher et al.
6,413,160 B1 7/2002 Vancura
6,416,408 B2 7/2002 Tracy et al.
6,416,409 B1 7/2002 Jordan
6,419,579 B1 7/2002 Bennett
6,419,583 B1 7/2002 Crumby et al.
6,425,828 B2 7/2002 Walker et al.
6,428,412 B1 8/2002 Anderson et al.
6,431,983 B2 8/2002 Acres
6,435,500 B2 8/2002 Gumina
6,435,511 B1 8/2002 Vancura et al.
6,435,968 B1 8/2002 Torango
6,439,993 B1 8/2002 O'Halloran
6,439,995 B1 8/2002 Hughs-Baird et al.
6,443,452 B1 9/2002 Brune
6,443,837 B1 9/2002 Jaffe et al.
6,450,884 B1 9/2002 Seelig et al.
6,454,266 B1 9/2002 Breeding et al.
6,454,651 B1 9/2002 Yoseloff
RE37,885 E 10/2002 Acres et al.
6,461,241 B1 10/2002 Webb et al.
6,464,582 B1 10/2002 Baerlocher et al.
6,471,208 B2 10/2002 Yoseloff et al.
6,471,591 B1 10/2002 Crumby
D465,531 S 11/2002 Luciano, Jr. et al.
6,481,713 B2 11/2002 Perrie et al.
6,482,089 B2 11/2002 Demar et al.
6,491,584 B2 12/2002 Graham et al.
6,494,454 B2 12/2002 Adams
6,506,118 B1 1/2003 Baerlocher et al.
6,508,707 B2 1/2003 DeMar et al.
6,508,709 B1 1/2003 Karmarkar
6,511,375 B1 1/2003 Kaminkow
6,511,376 B2 1/2003 Walker et al.
6,514,141 B1 2/2003 Kaminkow et al.
6,533,273 B2 3/2003 Cole et al.
6,533,658 B1 3/2003 Walker et al.
6,533,660 B2 3/2003 Seelig et al.
6,533,664 B1 3/2003 Crumby
6,537,150 B1 3/2003 Luciano et al.
6,537,152 B2 3/2003 Seelig et al.
6,546,134 B1 4/2003 Shrairman et al.
6,546,374 B1 4/2003 Esposito et al.
6,547,131 B1 4/2003 Foodman et al.
6,547,242 B1 4/2003 Sugiyama et al.
6,554,283 B2 4/2003 Vancura et al.
6,554,705 B1 4/2003 Cumbers
6,561,904 B2 5/2003 Locke et al.
6,565,434 B1 5/2003 Acres
6,565,436 B1 5/2003 Baerlocher
6,569,013 B1 * 5/2003 Taylor ..... 463/13
6,569,015 B1 5/2003 Baerlocher et al.
6,572,471 B1 6/2003 Bennett
6,575,830 B2 6/2003 Baerlocher et al.
6,575,832 B1 6/2003 Manfredi et al.
6,582,307 B2 6/2003 Webb
6,589,115 B2 7/2003 Walker et al.
6,592,460 B2 7/2003 Torango 6,595,853 B1 7/2003 Osawa
6,595,854 B2 7/2003 Hughs-Baird et al.
6,599,185 B1 7/2003 Kaminkow et al.
6,599,190 B2 7/2003 Osawa
6,599,193 B2 7/2003 Baerlocher et al.
6,602,135 B1 8/2003 Gerrard
6,602,137 B2 8/2003 Kaminkow et al.
6,604,740 B1 8/2003 Singer et al.
6,607,437 B2 8/2003 Casey et al.
6,607,441 B1 8/2003 Acres
6,609,971 B2 8/2003 Vancura
6,609,972 B2 8/2003 Seelig et al.
6,609,973 B1 8/2003 Weiss
6,616,142 B2 9/2003 Adams
6,616,531 B1 9/2003 Mullins
6,620,046 B2 9/2003 Rowe
6,626,758 B1 9/2003 Parham et al.
6,634,944 B2 10/2003 Osawa
6,637,747 B1 10/2003 Garrod
6,645,073 B2 11/2003 Lemay et al.
6,645,077 B2 11/2003 Rowe
6,648,759 B2 11/2003 Vancura
6,652,378 B2 11/2003 Cannon et al.
6,656,040 B1 12/2003 Brosnan et al.
6,656,043 B2 12/2003 Seelig et al.
6,656,047 B1 12/2003 Tarantino et al.
6,656,048 B2 12/2003 Olsen
6,656,052 B2 12/2003 Abramopoulos et al.
6,659,864 B2 12/2003 McGahn et al.
6,666,765 B2 12/2003 Vancura
6,672,959 B2 1/2004 Moody et al.
6,675,152 B1 1/2004 Prasad et al.
6,682,419 B2 1/2004 Webb et al.
6,682,420 B2 1/2004 Webb et al.
6,688,977 B1 2/2004 Baerlocher et al.
6,692,355 B2 2/2004 Baerlocher et al.
6,712,694 B1 3/2004 Nordman
6,712,695 B2 3/2004 Mothwurf et al.
6,712,697 B2 3/2004 Acres
6,715,756 B2 4/2004 Inoue
6,719,630 B1 4/2004 Seelig et al.
6,726,204 B2 4/2004 Inoue
6,726,563 B1 4/2004 Baerlocher et al.
6,746,328 B2 6/2004 Cannon et al.
6,749,504 B2 6/2004 Hughs-Baird
6,749,510 B2 6/2004 Giobbi
6,754,346 B2 6/2004 Eiserling et al.
6,761,632 B2 7/2004 Bansemer et al.
6,776,714 B2 8/2004 Ungaro et al.
6,776,715 B2 8/2004 Price
6,790,141 B2 9/2004 Muir
6,793,575 B2 * 9/2004 Brown et al. ..... 463/6
6,800,030 B2 10/2004 Acres
6,805,352 B2 10/2004 Hunter
6,811,483 B1 11/2004 Webb et al.
6,817,948 B2 11/2004 Pascal et al.
6,832,956 B1 12/2004 Boyd et al.
6,832,958 B2 12/2004 Acres et al.
6,837,788 B2 1/2005 Cannon
6,866,583 B2 3/2005 Glavich et al.
6,869,361 B2 3/2005 Sharpless et al.
6,884,168 B2 4/2005 Wood et al.
6,887,154 B1 5/2005 Luciano, Jr. et al.
6,889,849 B2 5/2005 Heidel et al.
6,899,625 B2 5/2005 Luciano, Jr. et al.
6,905,406 B2 6/2005 Kaminkow et al.
6,908,387 B2 6/2005 Hedrick et al.
6,910,964 B2 6/2005 Acres
6,913,532 B2 7/2005 Baerlocher et al.
6,918,832 B2 7/2005 Baerlocher et al.
6,918,834 B2 7/2005 Vancura
6,935,951 B2 8/2005 Paulsen et al.
6,935,958 B2 8/2005 Nelson
6,939,234 B2 9/2005 Beatty
6,942,574 B1 9/2005 LeMay et al.
RE38,812 E 10/2005 Acres et al.
6,955,600 B2 10/2005 Glavich et al.
6,966,834 B1 11/2005 Johnson
7,029,395 B1 4/2006 Baerlocher
7,169,042 B2 1/2007 Muir et al.
2001/0024971 A1 9/2001 Brossard
2001/0049303 A1 12/2001 Found
2001/0055990 A1 12/2001 Acres
2002/0002674 A1 1/2002 Grimes et al.
2002/0028707 A1 3/2002 Pascal et al.
2002/0039923 A1 4/2002 Cannon et al.
2002/0045472 A1 4/2002 Adams
2002/0045475 A1 4/2002 Glavich et al.
2002/0071557 A1 6/2002 Nguyen
2002/0094855 A1 7/2002 Berman
2002/0094862 A1 7/2002 Inoue
2002/0116615 A1 8/2002 Nguyen et al.
2002/0138594 A1 9/2002 Rowe
2002/0142822 A1 10/2002 Baerlocher et al.
2002/0142829 A1 10/2002 Inoue
2002/0152120 A1 10/2002 Howington
2002/0155880 A1 10/2002 Glavich et al.
2002/0165023 A1 11/2002 Brosnan et al.
2002/0177483 A1 11/2002 Cannon
2002/0187834 A1 12/2002 Rowe et al.
2002/0198036 A1 12/2002 Baerlocher et al.
2003/0027625 A1 2/2003 Rowe
2003/0027630 A1 2/2003 Kelly et al.
2003/0028779 A1 2/2003 Rowe
2003/0040355 A1 2/2003 Baerlocher
2003/0040358 A1 2/2003 Rothkranz et al.
2003/0040360 A1 2/2003 Kaminkow
2003/0045348 A1 3/2003 Palmer et al.
2003/0045350 A1 3/2003 Baerlocher et al.
2003/0045353 A1 3/2003 Paulsen et al.
2003/0050111 A1 3/2003 Saffari
2003/0054875 A1 3/2003 Marks et al.
2003/0054878 A1 3/2003 Benoy et al.
2003/0060254 A1 3/2003 Cuddy et al.
2003/0060266 A1 3/2003 Baerlocher
2003/0060267 A1 3/2003 Glavich et al.
2003/0060269 A1 3/2003 Paulsen et al.
2003/0060272 A1 3/2003 Glavich et al.
2003/0060279 A1 3/2003 Torango
2003/0064772 A1 4/2003 Tempest et al.
2003/0064773 A1 4/2003 Baerlocher et al.
2003/0064785 A1 4/2003 Stone et al.
2003/0064790 A1 4/2003 Hughs-Baird et al.
2003/0069056 A1 4/2003 Cormack et al.
2003/0069064 A1 4/2003 Ainsworth
2003/0073482 A1 4/2003 Baerlocher et al.
2003/0078089 A1 4/2003 Gray et al.
2003/0083943 A1 5/2003 Adams et al.
2003/0092484 A1 5/2003 Schneider et al.
2003/0119583 A1 6/2003 Kaminkow et al.
2003/0130041 A1 7/2003 Pascal et al.
2003/0144965 A1 7/2003 Prasad et al.
2003/0162584 A1 8/2003 Hughs-Baird et al.
2003/0162585 A1 8/2003 Bigelow et al.
2003/0181231 A1 9/2003 Vancura et al.
2003/0182574 A1 9/2003 Whitten et al.
2003/0195027 A1 10/2003 Baerlocher et al.
2003/0199321 A1 10/2003 Williams
2003/0207709 A1 11/2003 Paotrakul
2003/0207710 A1 11/2003 Rodgers et al.
2003/0211879 A1 11/2003 Englman
2003/0211884 A1 11/2003 Gauselmann
2003/0216166 A1 11/2003 Baerlocher et al.
2003/0222402 A1 12/2003 Olive
2003/0223803 A1 12/2003 De Schrijver
2003/0228904 A1 12/2003 Acres et al.
2003/0232643 A1 12/2003 Inoue
2003/0232647 A1 12/2003 Moser
2003/0236110 A1 * 12/2003 Beaulieu et al. ..... 463/1
2003/0236116 A1 12/2003 Marks et al.
2004/0000754 A1 1/2004 Inoue
2004/0002372 A1 1/2004 Rodgers et al.
2004/0009807 A1 1/2004 Miller et al.
2004/0009811 A1 1/2004 Torango
2004/0012145 A1 1/2004 Inoue
2004/0014516 A1 1/2004 Inoue
2004/0014517 A1 1/2004 Inoue
2004/0017041 A1 1/2004 Inoue

| | | | |
|---|---|---|---|
| 2004/0018866 | A1 | 1/2004 | Inoue |
| 2004/0026854 | A1 | 2/2004 | Inoue |
| 2004/0029631 | A1 | 2/2004 | Duhamel |
| 2004/0036218 | A1 | 2/2004 | Inoue |
| 2004/0038726 | A1 | 2/2004 | Inoue |
| 2004/0041340 | A1 | 3/2004 | Inoue |
| 2004/0048649 | A1 | 3/2004 | Peterson et al. |
| 2004/0048652 | A1 | 3/2004 | Ching et al. |
| 2004/0053658 | A1 | 3/2004 | Rothranz |
| 2004/0053659 | A1 | 3/2004 | Rothkranz et al. |
| 2004/0053670 | A1 | 3/2004 | Rothkranz et al. |
| 2004/0053671 | A1 | 3/2004 | Nordman |
| 2004/0053672 | A1 | 3/2004 | Baerlocher |
| 2004/0053673 | A1 | 3/2004 | Mishra |
| 2004/0053683 | A1 | 3/2004 | Hartl et al. |
| 2004/0053687 | A1 | 3/2004 | Nordman et al. |
| 2004/0072615 | A1 | 4/2004 | Maya et al. |
| 2004/0072619 | A1 | 4/2004 | Brosnan et al. |
| 2004/0087368 | A1 | 5/2004 | Gauselmann |
| 2004/0121840 | A1 | 6/2004 | Rosander et al. |
| 2004/0137982 | A1 | 7/2004 | Cuddy et al. |
| 2004/0147306 | A1 | 7/2004 | Randall et al. |
| 2004/0150161 | A1 | 8/2004 | Inoue |
| 2004/0152509 | A1 | 8/2004 | Hornik et al. |
| 2004/0155399 | A1 | 8/2004 | Inoue |
| 2004/0157658 | A1 | 8/2004 | Rothkranz |
| 2004/0171416 | A1 | 9/2004 | Baerlocher et al. |
| 2004/0171420 | A1 | 9/2004 | Baerlocher et al. |
| 2004/0180715 | A1 | 9/2004 | Nordman |
| 2004/0183251 | A1 | 9/2004 | Inoue |
| 2004/0235552 | A1 | 11/2004 | Gauselmann |
| 2004/0242297 | A1 | 12/2004 | Walker |
| 2005/0026694 | A1 | 2/2005 | Kelly et al. |
| 2005/0032573 | A1 | 2/2005 | Acres et al. |
| 2005/0053672 | A1 | 3/2005 | West |
| 2005/0054429 | A1 | 3/2005 | Baerlocher et al. |
| 2005/0070356 | A1 | 3/2005 | Mothwurf et al. |
| 2005/0075163 | A1 | 4/2005 | Cuddy et al. |
| 2005/0079908 | A1 | 4/2005 | Pacey |
| 2005/0079911 | A1 | 4/2005 | Nakatsu |
| 2005/0086478 | A1 | 4/2005 | Peinado et al. |
| 2005/0101374 | A1 | 5/2005 | Acres |
| 2005/0101375 | A1 | 5/2005 | Webb et al. |
| 2005/0101384 | A1 | 5/2005 | Parham |
| 2005/0119047 | A1 | 6/2005 | Olive |
| 2005/0143168 | A1 | 6/2005 | Torango |
| 2005/0143169 | A1 | 6/2005 | Nguyen et al. |
| 2005/0159211 | A1 | 7/2005 | Englman |
| 2005/0163377 | A1 | 7/2005 | Walch |
| 2005/0176488 | A1 | 8/2005 | Olive |
| 2005/0178716 | A1 | 8/2005 | Suri |
| 2005/0192083 | A1 | 9/2005 | Iwamoto |
| 2005/0192099 | A1 | 9/2005 | Nguyen et al. |
| 2005/0197180 | A1 | 9/2005 | Kaminkow et al. |
| 2005/0209004 | A1 | 9/2005 | Torango |
| 2005/0227754 | A1 | 10/2005 | Kaminkow et al. |
| 2005/0239542 | A1 | 10/2005 | Olsen |
| 2005/0267610 | A1 | 12/2005 | Shinoda |
| 2005/0282626 | A1 | 12/2005 | Manfredi et al. |
| 2006/0003829 | A1 | 1/2006 | Thomas |
| 2006/0009285 | A1 | 1/2006 | Pryzby et al. |
| 2006/0025201 | A1 | 2/2006 | Van Asdale |
| 2006/0025210 | A1 | 2/2006 | Johnson |
| 2006/0026604 | A1 | 2/2006 | Tan et al. |
| 2006/0030397 | A1 | 2/2006 | Chan |
| 2006/0035694 | A1 | 2/2006 | Fuller |
| 2006/0035706 | A1 | 2/2006 | Thomas et al. |
| 2006/0036552 | A1 | 2/2006 | Gunyakti et al. |
| 2006/0040732 | A1 | 2/2006 | Baerlocher et al. |
| 2006/0040736 | A1 | 2/2006 | Baerlocher et al. |
| 2006/0052159 | A1 | 3/2006 | Cahill et al. |
| 2006/0052161 | A1 | 3/2006 | Soukup et al. |
| 2006/0052162 | A1 | 3/2006 | Soukup et al. |
| 2006/0068897 | A1 | 3/2006 | Sanford et al. |
| 2006/0073889 | A1 | 4/2006 | Edidin et al. |
| 2006/0073897 | A1 | 4/2006 | Englman et al. |
| 2006/0178203 | A1 | 8/2006 | Hughes et al. |
| 2007/0060319 | A1 | 3/2007 | Block et al. |

FOREIGN PATENT DOCUMENTS

| | | | |
|---|---|---|---|
| AU | 555905 | | 10/1986 |
| AU | 567001 | | 11/1987 |
| AU | 585160 | | 6/1989 |
| AU | 589158 | | 10/1989 |
| AU | 593059 | | 2/1990 |
| AU | 630112 | | 3/1990 |
| AU | 628330 | | 9/1992 |
| AU | 633469 | | 1/1993 |
| AU | 649009 | | 5/1994 |
| AU | 655801 | | 1/1995 |
| AU | 1996 70247 | | 4/1997 |
| AU | 680920 | | 8/1997 |
| AU | 1997 16432 | | 9/1997 |
| AU | 1997 17601 | B2 | 9/1997 |
| AU | 1996 50327 | A | 10/1997 |
| AU | 1997 47657 | B2 | 6/1998 |
| AU | 1997 43615 | | 7/1998 |
| AU | 1998 63553 | A | 10/1998 |
| AU | 1998 84162 | A1 | 3/1999 |
| AU | 707687 | | 7/1999 |
| AU | 1999 17318 | A1 | 9/1999 |
| AU | 709724 | | 9/1999 |
| AU | 711501 | | 10/1999 |
| AU | 716299 | | 2/2000 |
| AU | 721968 | | 7/2000 |
| AU | 722107 | | 7/2000 |
| AU | 728788 | | 1/2001 |
| AU | 2001 1000032 | | 11/2001 |
| AU | 2001 1000033 | | 11/2001 |
| AU | 748263 | | 5/2002 |
| AU | 749222 | | 6/2002 |
| AU | 754689 | | 11/2002 |
| AU | 758306 | | 3/2003 |
| AU | 1999 43453 | C | 4/2003 |
| DE | 3415114 | | 11/1985 |
| DE | 8710757 | | 11/1987 |
| DE | 3638100 | | 11/1988 |
| DE | 3917683 | | 12/1990 |
| DE | 4200254 | | 8/1993 |
| DE | 4301855 | | 7/1994 |
| DE | 19600787 | C2 | 5/1997 |
| DE | 19613455 | C2 | 8/1997 |
| DE | 19936196 | A1 | 1/2001 |
| DE | 3700861 | A1 | 8/2004 |
| EP | 0 342 797 | | 11/1989 |
| EP | 0 444 932 | | 2/1991 |
| EP | 0 449 433 | A2 | 10/1991 |
| EP | 0 798 676 | A1 | 10/1997 |
| EP | 0 874 337 | A1 | 10/1998 |
| EP | 0874337 | A1 | 10/1998 |
| EP | 0 926 645 | A2 | 6/1999 |
| EP | 0 944 030 | A2 | 9/1999 |
| EP | 0 945 837 | A2 | 9/1999 |
| EP | 0945837 | A2 | 9/1999 |
| EP | 0 981 119 | A2 | 2/2000 |
| EP | 0 984 408 | A2 | 3/2000 |
| EP | 0 984 409 | A2 | 3/2000 |
| EP | 1 003 138 | A2 | 5/2000 |
| EP | 0984407 | A2 | 8/2000 |
| EP | 1 467 329 | A2 | 10/2004 |
| EP | 1 498 860 | A1 | 1/2005 |
| EP | 1 513 114 | A2 | 3/2005 |
| EP | 1 528 516 | A2 | 5/2005 |
| EP | 1 528 517 | A2 | 5/2005 |
| GB | 912 685 | | 12/1962 |
| GB | 2 083 936 | A | 3/1982 |
| GB | 2 096 376 | A | 10/1982 |
| GB | 2 097 160 | A | 10/1982 |
| GB | 2 100 905 | A | 1/1983 |
| GB | 2 117 155 | A | 10/1983 |
| GB | 2 117 952 | A | 10/1983 |
| GB | 2 118 445 | | 11/1983 |
| GB | 2 144 644 | A | 3/1984 |
| GB | 2 137 392 | A | 10/1984 |
| GB | 2 139 390 | | 11/1984 |
| GB | 2 142 457 | A | 1/1985 |
| GB | 2 147 773 | | 5/1985 |
| GB | 2 148 135 | | 5/1985 |

| | | | |
|---|---|---|---|
| GB | 1 151 054 | A | 7/1985 |
| GB | 2 153 572 | A | 8/1985 |
| GB | 2 161 008 | A | 1/1986 |
| GB | 2 161 009 | A | 1/1986 |
| GB | 2 170 636 | A | 8/1986 |
| GB | 2 180 682 | A | 4/1987 |
| GB | 2 181 589 | A | 4/1987 |
| GB | 2 183 882 | A | 6/1987 |
| GB | 2 201 821 | A | 9/1987 |
| GB | 2 191 030 | A | 12/1987 |
| GB | 2 222 712 | A | 3/1990 |
| GB | 2 226 436 | A | 6/1990 |
| GB | 2 226 907 | A | 7/1990 |
| GB | 2 231 189 | | 11/1990 |
| GB | 2 282 690 | | 4/1995 |
| GB | 2 322 217 | A | 8/1998 |
| GB | 2 333 880 | A | 9/1998 |
| GB | 2 328 311 | | 2/1999 |
| GB | 1 353 128 | A | 2/2001 |
| GB | 2 383 668 | A | 11/2001 |
| GB | 2 387 703 | | 10/2003 |
| JP | 7148307 | | 6/1995 |
| JP | 2002-320703 | | 11/2002 |
| WO | WO 94 12256 | | 6/1994 |
| WO | WO 95 22811 | | 8/1995 |
| WO | WO 95 30944 | | 11/1995 |
| WO | WO 97 12338 | | 4/1997 |
| WO | WO 97 27568 | | 7/1997 |
| WO | WO 97 32285 | | 9/1997 |
| WO | WO 98 00210 | | 1/1998 |
| WO | WO 98 35309 | | 8/1998 |
| WO | WO 98 47115 | | 10/1998 |
| WO | WO 98 51384 | | 11/1998 |
| WO | WO 99 03078 | | 1/1999 |
| WO | WO 99 10849 | | 3/1999 |
| WO | WO 00 12186 | | 3/2000 |
| WO | WO 00/20082 | | 4/2000 |
| WO | WO 00 32286 | | 6/2000 |
| WO | WO 00 66235 | | 11/2000 |
| WO | WO 00 76606 | | 12/2000 |
| WO | WO 01 10523 | | 2/2001 |
| WO | WO 01 15055 | | 3/2001 |
| WO | WO 01 15790 | | 3/2001 |
| WO | WO 01 26019 | | 4/2001 |
| WO | WO 02/096528 | A2 | 12/2002 |
| WO | WO 03 030066 | | 4/2003 |
| WO | WO 03 075235 | | 9/2003 |
| WO | WO 2004 035161 | | 4/2004 |
| WO | WO 2004 066061 | | 8/2004 |
| WO | WO 2005 027058 | | 3/2005 |
| WO | WO 2005 076193 | | 8/2005 |
| WO | WO 2005 081623 | | 9/2005 |
| WO | WO 2005 083599 | | 9/2005 |
| WO | WO 2005 099425 | | 10/2005 |
| WO | WO 2005 099845 | | 10/2005 |
| WO | WO 2005 106702 | | 11/2005 |
| WO | WO 2005 113093 | | 12/2005 |
| WO | WO 2006 014770 | | 2/2006 |
| WO | WO 2006 014883 | | 2/2006 |
| WO | WO 2006 014990 | | 2/2006 |
| WO | WO 2006 039366 | | 4/2006 |

OTHER PUBLICATIONS

American Bandstand Article written by in Strictly Slots, published in 2002.
American Bandstand Brochure written by Anchor Games, published in 2001.
Aristrocrat Brochure, written by Aristocrat Gaming, published in 2004.
Atronic Systems Progressive Products at G2E, published by Atronic in 2004, printed from ForRelease.com.
Austin Powers in Goldmember™ Advertisement written by IGT, published in 2003.
Bally Slot Machines Electro-Mechanicals 1964-1980 Book [In Part], Revised 3rd Edition written by Marshall Fey.
Big Shot!™ Advertisement published by Aristocrat Technologies, Inc., published in 2002.
Big Top Keno Advertisement published by Aristocrat Technologies, Inc., published in 2000.
Bingo Game Brochure written by Casino Data System, published in 1998.
Bonus Roulette Brochure written by F. Franco, published prior to Sep. 2003.
Buck's Roulette Brochure written by R. Franco, published prior to Sep. 2003.
Cartoon Jackpots description, printed from www.ballygaming.com/home.asp, on Feb. 4, 2005.
Cash Express Advertisements, written by Aristocrat, published in 2002.
Cashing In Article, written by Strictly Slots, published in Aug. 2006.
Chariot's of Fortune Brochure written by R. Franco, published prior to Sep. 2003.
Classic Pot of Gold Brochure written by Ace Coin Equipment Ltd., published prior to Sep. 2003.
Crazy Fruits Article written by Strictly Slots, published in Apr. 2001.
Cyberdyne Gaming Brochure written by Cyberdyne Gaming, published prior to Sep. 11, 2003.
Double Diamond Girls Advertisement, written by A.C. Coin and Slot Services Company, published prior to Sep. 11, 2003.
Double Spin Five Times Pay Advertisement, written by IGT, published prior to 2000.
Double up Poker Game Description written by IGT, available prior to Sep. 2000.
Elvira® Mistress of the Dark™ Advertisement written by IGT, published in 2002.
Elvis Hits Advertisement written by IGT, published in 1999.
Ez-Pay and Related Brochures published by IGT in 2000.
Fast Buck Systems Manual, written by International Game Technology, available to Mirage shift supervisors at least as early as May 30, 1990.
Fortune Cookie Brochure written by IGT, published in 2000.
Full House Brochure written by Anchor Games, published in 2000.
High Low Card Game written by Qeocities.com, printed May 3, 2001.
Holy Smoke Brochure written by Impulse Gaming Ltd., published prior to Sep. 2003.
Honeymooners Advertisement, written by AC Coin & Slot, published in 2002.
Hot Shot Progressive Article, written by Strictly Slots, published in Feb. 2006.
In Between Game Description written by IGT, available prior to Sep. 2000.
Jack and the Beanstalk™ Article written by Strictly Slots, published Jul. 2002.
Jackpot Carnival Hyperlink Advertisement, written by Aristocrat, published prior to 2002.
Jackpot Hotline Advertisement, written by AC Coin and Slot, published prior to Sep. 2003.
Jackpot Hunter Advertisement, written by IGT, available prior to Jan. 2005.
Keystone Cash Description, written by IGT, available prior to Sep. 12, 2006.
King of the Grill™ Brochure written by AC Coin & Slot, published prior to Sep. 2003.
Lemons, Cherries and Bell-Fruit-Gum written by Richard M. Bueschel, pp. 39-41, 64, 70, 137, 149-150, 195-196 and 251, 1995.
Lemons, Cherries and Bell-Fruit-Gum, pp. 1 to 4 and 304 to 314, written by Bueschel, published in Royal Bell Books in Nov. 1995.
Line-Up Brochure written by AC Coin & Slot, published prior to Sep. 2003.
Little Green Men Jr.™ Advertisement written by AC Coin & Slot, published prior to Sep. 11, 2003.
Little Green Men Jr.™ Article written by Strictly Slots, published in Feb. 2003.
Magic 8 Ball Advertisement written by IGT, published in 2002.
Mikohn Product Catalog, Chapters 1, 2, 6, 7 and 8, written by Mikohn, published in Jan. 1993.
Mikohn Ripley's Believe It or Not Article written by Strictly Slots published in 2001.

Mikohn Super Controller Manual, Chapters 1 to 3 and 6 to 7, written by Mikohn, published in 1989.
Millioni$er articles, written by Strictly Slots, published in Sep. 2003 and Mar. 2004.
Miss America Brochure written by AC Coin & Slot, published prior to Sep. 11, 2003.
Mix and Match Advertisement published by AC Coin & Slot, published prior to Sep. 2003.
Mix and Match Article written by Strictly Slots, published in Apr. 2002.
Money Grab Article written by Strictly Slots, published in Apr. 2001.
Money Time advertisement, written by Mikohn Gaming, published in 1999.
Money to Burn Brochure written by WMS Gaming, Inc., published prior to 2001.
Monster Match Advertisement by Strictly Slots, published prior to Sep. 9, 2003.
Monster Match Article, written by Strictly Slots, published in Jan. 2002.
Monte Carlo Advertisement written by Bally Gaming, published prior to Sep. 2002.
M-Slot Series Primary Reel Product description from Lemons, Cherries and Bell-Fruit-Gum, written by Richard M. Bueschel, published in 1995.
Official Rules for "1 v 100" gameshow printed from http://www.nbc.com/Casting/Applications/1v100_rules.pdf on Jun. 28, 2007, pp. 1-7.
On the Money! Article written by Strictly Slots, published in Dec. 2000.
Payout!™ Advertisement written by www.csds.com/Gaming/Products/g Payout.htm, printed on Jan. 15, 2001.
Payout! ™ Article written by Casino Data Systems, published prior to Sep. 2003.
PEM—Precision Electronic Meter, written by GRIPS Electronic GmbH, printed from website reported as archived on Feb. 20, 1997 (available at http://web.archive.org/web/19970220165753/www.grips.com/pem.htm).
Penguin Pucks article, written by Note in Gaming Marketplace, published prior to 2004.
Pick a Prize Brochure written by Acres Gaming Incorporated, published prior to 2001.
Player Tracking and Related Brochures published by IGT at least in 2001.
Player Tracking on Slots, written by GRIPS Electronic GmbH, printed from website reported as archived on Feb. 20, 1997 (available at http://web.archive.org/web/19970220165921/www.grips.com/playtrac.htm).
Plinko Showcase Show Down written by International Game Technology, published in 2001.
Power Slotto Brochure published by AC Coin & Slot prior to 2002.
Press Your Luck Brochure published by AC Coin & Slot prior to 2002.
Progressive Jackpot System article, printed from casinomagazine.com.managearticle.asp@c_290&a=518, on Jun. 21, 2004.
ProLINK Progressive Controller User/Reference Manual, written by Casino Data Systems, published in Apr. 1997.
Quick Pick Paytime Brochure written by Acres Gaming Incorporated, published prior to 2001.
R&B™ Brochure published by AC Coin & Slot, published prior to Sep. 2003.
Raining Diamonds Advertisement published by Sierra Design Group in 2001.
Reel Dice Advertisement written by Gerber & Glass, published in 1936.
Royal Roulette Brochure written by Impulse Gaming Ltd., published prior to Sep. 2003.
Run for Your Money Game Description written by Barcrest, published prior to 2001.
Scarne, Scarne's New Complete Guide to Gambling, 1974, Simon & Schuster, 162-167.
Scarne, Scarne's Encyclopedia of Card Games, 1973, HarperCollins Publishers, Inc., 278-279.
Simpson, "Wynn Boasts High-Tech Slot Floor," Feb. 2005, Las Vegas Sun, pp. 1-4.
Silver City Roundup Brochure published by AC Coin & Slot, published prior to Sep. 2003.
Silver Strike Advertisement and Pictures published by Anchor Gaming in 1997.
Slot Line Progressive Advertisement, written by IGT, published in 1993.
Slot Line Progressive Advertisement, written by IGT, published in 1994.
Slot Line Progressive Advertisement, written by IGT, published in 1995.
Slot Line Progressive Mega Jackpots Advertisement, written by IGT, published in 1997.
Slot Line Temperature Rising Game Description, written by IGT, published in 1998.
Slot Machine Buyer's Handbook, A Consumer's Guide to Slot Machines written by David L. Saul and Daniel R. Mead, published in 1998.
Slot Machines A Pictorial History of the First 100 Years (pp. 216, 242 to 243), 5th edition, written by Marshall Fey, published in 1983-1997.
Slot Machines and Coin-Op Games written by Bill Kurtz, pp. 16, 65, 105 and 111, 1991.
Slot Machines on Parade, 1st edition written by Robert N. Geddes and illustrated by Daniel R. Mead, published in 1980.
Sloto Instant Article published by Strictly Slots in Apr. 2001.
Sphinx Brochure written by Atronic Casino Technology, Ltd., published in 1997.
Spin Til You Win Information Sheet written by IGT, published in 1996.
Spin-A-Lot Brochure written by Acres Gaming Incorporated, published prior to 2001.
Station's Jumbo Jackpot description, printed from http://www.stationcasinos.com/gaming/boarding-pass/promos/jumbojackpot/ on Jun. 28, 2007.
Super Cherry Advertisement written by IGT in 2001.
Surprize Gaming Machine Advertisement, written by Aristocrat Leisure Industries, Australia, published prior to 2004.
Surprize Software Specification for MV2030—var 01, written by Aristocrat Leisure Industries, Australia, published prior to 2004.
Take Your Pick Article written by Strictly Slots, published in Mar. 2001.
Take Your Pick Brochure and Article written by IGT/Anchor Games, Strictly Slots, published in 1999.
The Killer List of Video Games, Soda Pop Tapper, Bally Midway, 1984, The International Arcade Museum.
Top Dollar Brochure written by IGT, published in 1998.
Wheel & Deal Brochure written by Strictly Slots, published in Dec. 2001.
Wheel of Fortune Advertisement written by IGT, published in 1998.
Wheel Poker Article, written by Strictly Slots, published prior to 2002.
Wide Area Progressive Link System, written by GRIPS Electronic GmbH, printed from website reported as archived on Feb. 20, 1997 (available at http://web.archive.org/web/19970220165457/www.grips.com/wap.htm).
Wiser, "Running The Floor," Nov. 2005, Strictly Slots, pp. 22-25.
Yahtzee Bonus Advertisement written by Mikohn, published in 1999.
Zorro Advertisement, written by Aristocrat, published in 2004.

* cited by examiner

FIG. 4

TOTAL AWARD: $50,000

| ROUND | ELIGIBLE PLAYERS | ADVANCING PLAYERS | AWARD PER ADVANCING PLAYER |
|---|---|---|---|
| 1 | 800 | 400 | $0 |
| 2 | 400 | 200 | $0 |
| 3 | 200 | 100 | $0 |
| 4 | 100 | 50 | $0 |
| 5 | 50 | 25 | $0 |
| 6 | 25 | 12 | $0 |
| 7 | 12 | 6 | $0 |
| 8 | 6 | 3 | $0 |
| 9 | 3 | 2 | $0 |
| 10 | 2 | 1 | $50,000 |

Award Provided to the Player Who Advanced in Round 10.

FIG. 5

TOTAL AWARD: $100,000

| ROUND | ELIGIBLE PLAYERS | ADVANCING PLAYERS | AWARD PER ADVANCING PLAYER |
|---|---|---|---|
| 1 | 800 | 400 | $0 |
| 2 | 400 | 200 | $0 |
| 3 | 200 | 100 | $0 |
| 4 | 100 | 50 | $0 |
| 5 | 50 | 5 | $20,000 |

Award Provided to the Players Who Advanced in Round 5.

FIG. 6A

TOTAL AWARD: $100,000

| ROUND | ELIGIBLE PLAYERS | ADVANCING PLAYERS | AWARD PER ADVANCING PLAYER |
|---|---|---|---|
| 1 | 800 | 200 | $0 |
| 2 | 200 | 50 | $0 |
| 3 | 50 | 10 | $0 |
| 4 | 10 | 5 | $0 |
| 5 | 5 | 0 | $100,000 |

Five Players Advance to Round 5 and Zero Players Advance in Round 5.

FIG. 6B

TOTAL AWARD: $100,000

| ROUND | ELIGIBLE PLAYERS | ADVANCING PLAYERS | AWARD PER ADVANCING PLAYER |
|---|---|---|---|
| 1 | 800 | 200 | $0 |
| 2 | 200 | 50 | $0 |
| 3 | 50 | 10 | $0 |
| 4 | 10 | 5 | $20,000 |
| 5 | 5 | 0 | $0 |

Award Provided to the Five Players Who Advanced to Round 5 Because Zero Players Advance in Round 5.

FIG. 7

TOTAL AWARD PER ROUND: $10,000

| ROUND | ELIGIBLE PLAYERS | ADVANCING PLAYERS | AWARD WON PER ADVANCING PLAYER | CONTINUING PLAYERS | INELIGIBLE PLAYERS | TOTAL ACCUMULATED AWARD |
|---|---|---|---|---|---|---|
| 1 | 800 | 400 | $25 | 300 | 400 | $25 |
| 2 | 300 | 200 | $50 | 100 | 100 | $75 |
| 3 | 100 | 50 | $200 | 20 | 50 | $275 |
| 4 | 20 | 5 | $2,000 | 2 | 15 | $2,245 |
| 5 | 2 | 1 | $10,000 | 0 | 1 | $12,275 |

Total Accumulated Award Provided to the Player Who Advanced in Round 5.

FIG. 8

BONUS EVENT AWARD: $100,000

| ROUND | ELIGIBLE PLAYERS | ADVANCING PLAYERS | AWARD WON PER ADVANCING PLAYER |
|---|---|---|---|
| 1 | 800 | 500 | $10 |
| 2 | 500 | 200 | $50 |
| 3 | 200 | 100 | $100 |
| 4 | 100 | 75 | $200 |
| 5 | 75 | 50 | $500 |
| 6 | 50 | 25 | $1,000 |
| 7 | 25 | 20 | $2,000 |
| 8 | 20 | 14 | $5,000 |
| 9 | 14 | 10 | $10,000 |
| 10 | 10 | 3 | $100,000 |

Additional Award Provided to each Advancing Player Per Round and Award Provided to the Players Who Advanced in Round 10.

FIG. 9A

TOTAL AWARD: $100,000

| ROUND | ELIGIBLE PLAYERS | ADVANCING PLAYERS | AWARD WON PER ADVANCING PLAYER PER ROUND |
|---|---|---|---|
| 1 | 800 | 400 | $2 |
| 2 | 400 | 200 | $10 |
| 3 | 200 | 100 | $50 |
| 4 | 100 | 25 | $300 |
| 5 | 25 | 5 | $1,000 |
| 6 | 5 | 0 | $100,000 |

Additional Award Provided to each Advancing Player Per Round, Five Players Advance to Round 5 and Zero Players Advance in Round 5.

FIG. 9B

TOTAL AWARD: $100,000

| ROUND | ELIGIBLE PLAYERS | ADVANCING PLAYERS | AWARD WON PER ADVANCING PLAYER PER ROUND |
|---|---|---|---|
| 1 | 800 | 400 | $2 |
| 2 | 400 | 200 | $10 |
| 3 | 200 | 100 | $50 |
| 4 | 100 | 25 | $300 |
| 5 | 25 | 5 | $20,200 |
| 6 | 5 | 0 | $0 |

Award Provided to the Five Players Who Advanced to Round 5 Because Zero Players Advance in Round 5.

GAMING SYSTEM AND METHOD PROVIDING VENUE WIDE SIMULTANEOUS PLAYER PARTICIPATION BASED BONUS GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. Part of the enjoyment and excitement of playing certain gaming machines is the occurrence or triggering of the secondary or bonus game (even before the player knows how much the bonus award will be). In other words, obtaining a bonus event and a bonus award in the bonus event is part of the enjoyment and excitement for players.

Player tracking systems are also known. Player tracking systems enable gaming establishments to recognize the value of customer loyalty through identifying frequent customers and rewarding those customers for their patronage. The cumulative history of a particular player's gaming activity, which is included in a player profile, enables gaming establishments to target individual players with direct marketing promotions or customized compensation plans. In existing player tracking systems, a player is issued a player identification card which has an encoded player identification number that uniquely identifies the player. Player tracking on gaming devices such as slot machines, is typically accomplished with a card reader mounted to the gaming device. When the player is at a gaming device, the player inserts the card into the card reader. The card reader reads the player identification number from the player tracking card and communicates information regarding the player's subsequent gaming activity through a network to a central computer. Based on this communicated information or data, the gaming establishment classifies each player and provides one or more of such players certain benefits based on these classifications.

One known benefit provided by such player tracking systems includes providing a bonus event to a group of players that have their player tracking card inserted into a gaming device (i.e., carded players). Such bonus events offer the players incentives, such as opportunities to win one or more awards, in exchange for the players' patronage at the gaming device and/or at the gaming establishment. Generally, a bonus controller or central server in association with the player tracking system selects a designated winning player from the group of carded players to win one of the awards associated with the bonus event. In one known bonus event, the award is provided to a randomly determined player chosen from all of the carded players. In such bonus events, the award may be a randomly determined amount and/or provided at a randomly determined time. In other such bonus events, the bonus controller or central server enables the group of carded players to participate in a game, such as a Bingo game, wherein the designated winning players are provided the award associated with the bonus event.

While rewarding carded players is popular amongst players and encourages participation in such player tracking systems, a number of issues exist with these known player tracking systems. First, participating in such player tracking systems does not enable the players to input choices or determinations that will affect the award (or the players' chances of winning the award). Additionally, since the bonus controller or central server designates a winning player, an award amount and/or a time at which the award will be provided to the winning player in association with these player tracking systems, certain players may believe that a significant amount of time and money are required to win the award. This may discourage certain players from playing a gaming device, especially if those players have a limited amount of money to play with or a limited amount of time to play.

There is a continuing need to provide new and different gaming machines and gaming systems as well as new and different ways to provide awards to players including bonus awards.

SUMMARY

One embodiment of the gaming system and method disclosed herein simultaneously provides a multi-round bonus event to a plurality of players wherein each players' input(s) determine, at least in part, an award, if any, provided to that player for the bonus event. In one embodiment, upon an occurrence of a suitable triggering event, a central controller of the gaming system identifies at least one player and preferably a plurality of players who are eligible to win an award in a bonus event. The central controller provides the bonus event (or causes the bonus event to be provided) to those eligible players. In one such embodiment, the central controller enables one or more eligible players in the gaming system to simultaneously (or substantially simultaneously) attempt to win the award in the bonus event. In this embodiment, the outcome of the bonus event is determined, at least in part, by one or more player inputs, choices or decisions in the bonus event.

In one embodiment, the central controller determines and defines one or more awards for a bonus event without selecting a winning player for those awards. The central controller identifies which players of which gaming machines in the gaming system are eligible for the bonus event. After this identification, the central controller simultaneously (or substantially simultaneously) provides the bonus or secondary event or game (or causes the bonus or secondary event or game to be provided) to the identified eligible players. In the bonus game, which may be any suitable multi-round bonus or secondary game, the eligible players compete with one another to win at least one award. The central controller selects the winning player for the one or more awards based on choices or decisions input by the players during the bonus event. As the bonus event progresses, the players make inputs that determine their eligibility for the award. Player inputs from certain players cause the central controller to eliminate those players from the bonus event. The central controller designates the eliminated players to be ineligible for the award. After these certain players are eliminated from the bonus event, any of the eligible players remaining in the bonus event have a chance to win the award. In one embodiment, the bonus game continues until a designated number of players, such as one player, remains in the bonus game. When a designated number of eligible players remain in the bonus game, the central controller determines which eligible player or players win the award (or a portion of the award). In various embodiments, the designated number is one, two or any other suitable number. The bonus game ends when the central controller provides the award (or a portion of the award) to the determined winning player or players. In one embodiment, as players are eliminated from the bonus game, each eligible player remaining in the bonus game has an opportunity to win a greater share or portion of the award.

In one embodiment, the bonus event ends after a designated number of rounds including a final round. In another embodiment, the bonus event ends when a designated number of eligible players remain in the bonus event. In another embodiment, the bonus event ends if when none of the players pick the designated selection (or make an input associated with a designated outcome, such as a winning outcome) in one of the rounds.

In one embodiment, the bonus event includes a plurality of rounds. In this embodiment, each of the eligible players makes inputs from a plurality of outcomes in each round. The central controller of the gaming system designates (or causes a designation of) at least one of the available outcomes in each round as a designated outcome (i.e., a winning outcome). The available outcomes also include non-designated outcomes (i.e., losing outcomes). If one of the players' inputs is associated with the winning outcome in an initial round, that player advances to a subsequent round of the bonus game. In one embodiment, the central controller provides each player who advances to the subsequent round with an additional award. For each player whose input is associated with a losing outcome (i.e., picks a non-designated outcome), the central controller eliminates that player from the bonus game. In one embodiment, any remaining players continue to make inputs in each subsequent round until a designated number of players advance to a final round. In the final round, if one of the remaining players makes an input that is associated with the winning outcome, the central controller provides that player (or causes the player to be provided) with the award (or a portion of the award if a plurality of the remaining players make inputs associated with the winning outcome). Accordingly, the bonus event enables players to make inputs or choices that affect the award, if any, that will be provided to those players in the bonus event. Such a configuration provides increased excitement and enjoyment for players because the players are provided with the ability to make inputs or choices in the bonus game that affect the outcome of the bonus game.

In one example embodiment, the bonus event includes a bonus game, such as a non-skill based selection game having a plurality of rounds. In this embodiment, each of the eligible players makes selections from a number of available selections (such as from a plurality of potential outcomes or selections) in each round. A central controller of the gaming system designates at least one of the available selections in each round as a designated selection (i.e., a winning outcome). If one of the players picks the designated selection in an initial round, that player advances to a subsequent round of the bonus game. In one embodiment, the central controller provides each player who advances to the subsequent round with an additional award. For each player that does not pick the designated selection (i.e., picks a selection other than the designated selection, such as a non-designated selection or a losing outcome), the central controller eliminates that player (or causes that player to be eliminated) from the bonus game. In one embodiment, any remaining players continue to pick from the selections in each subsequent round until one or more players advance to a final round. In the final round, if one of the remaining players picks the designated selection, the central controller provides that player with the award (or a portion of the award if a plurality of the remaining players pick the designated selection). Accordingly, the bonus event enables players to make inputs or choices (i.e., pick selections) that affect the award, if any, that will be provided to those players in the bonus event. Such a configuration provides increased excitement and enjoyment for players because the players are provided with the ability to make choices in the bonus game that affect the outcome of the bonus game.

In one embodiment, the central controller determines to provide a bonus event upon an occurrence of a triggering event or qualifying condition. In one embodiment, the triggering event or qualifying condition occurs based on a play of a game at one of the gaming machines in the gaming system. For example, the triggering event or qualifying condition is a symbol-driven event, such as a generated symbol or symbol combination in a primary game of one of the gaming machines in the gaming system. In another embodiment, the triggering event or qualifying condition occurs by exceeding a certain amount of game play (number of games, number of credits, amount of time) or reaching a specified number of points earned during game play. In an alternative embodiment, the triggering event or qualifying condition occurs randomly and independent of game play. In different embodiments, the triggering event or qualifying condition is predetermined, randomly determined, determined or weighted based on the player's wager, determined or weighted based on the status of one or more players (such as determined through a player tracking system), determined based on time, or determined based on any other suitable parameter or function.

In one embodiment, once the central controller detects an occurrence of a suitable triggering event, the central controller determines which players are eligible for the bonus event in association with a suitable player tracking system. In one embodiment, the central controller determines which players of the gaming machines in the gaming system are eligible for the bonus event by tracking when players insert and remove their player tracking card into one of the gaming machines in the gaming system. In another embodiment, the central controller determines which players of the gaming machines in the gaming system are eligible for the bonus event by determining which system gaming machines will provide the bonus event and designating the players at these system gaming machines as eligible players. It should be appreciated that the central controller may provide the bonus event to a plurality of or each of the eligible players and/or gaming machines.

In one embodiment, the bonus event includes a plurality of rounds, wherein each round has a number of available selections. In this embodiment, players must pick a designated selection (i.e., a winning outcome) in each round to win all or a share of the award. If at least one player picks the designated selection in a first round, that player advances to a second round. If at least one player does not pick the designated selection in the first round, that player is eliminated from the bonus event and does not advance to the second round. In the second round, the advancing players pick from a plurality of available selections in an attempt to advance to a third round. Similarly, players who pick the designated selection in the second round advance to the third round. Players who do not pick the designated selection in the second round are eliminated from the bonus event and do not advance to the third round. During the plurality of rounds, once a player does not pick the designated selection in a given round, that player is eliminated from the bonus event and is thus disqualified from winning the award. In this embodiment, this process continues for a number of rounds until at least one player reaches a final round. If none of the players reach the final round, the central controller ends the bonus event. For each player that reaches the final round, the award associated with the bonus event is available to one or more of those players. To be provided the available award, the one or more players must pick the designated selection in the final round. In one embodiment, the award is divided or split among a plurality of the players if those players pick the designated selection in each round including the final round.

In an alternative embodiment, each round of the bonus event is associated with an additional award. The central controller provides each player who picks the designated selection in one of the rounds with the additional award associated with that round. That is, each time one of the players picks the designated selection in one of the rounds, the central controller provides that player (or causes the player to be provided) with the additional award associated with that pick. In one embodiment, the central controller provides a consolation award (or causes the consolation award to be provided) to each player who did not pick the designated selection in one of the rounds.

In one embodiment, players can win an additional award associated with each round as described above and any additional awards won in the plurality of rounds are accumulated into a total award. In this embodiment, if the player picks the designated selection in one of the rounds, the central controller offers that player to either quit the bonus event and keep the total award accumulated in the bonus event or continue the bonus event and play a subsequent round. If the player chooses to quit, the central controller provides (or causes that player to be provided) with the accumulated award. If the player chooses to continue and does not pick the designated selection in a subsequent round, that player loses or forfeits any awards accumulated in the bonus event. In this embodiment, the total accumulated award is offered to each advancing player along with the option to quit as described above. In one embodiment, the total accumulated award offered to the players increases with each round, which creates excitement for those players who continue playing the bonus event for one or more subsequent rounds.

For example, a first round may be associated with a first award (e.g., $25), a second round may be associated with a second award (e.g., $50) and a third round may be associated with a third award (e.g., $200). If ten players pick the designated selection in the first round, the central controller offers those ten players to either quit the bonus event and accept the $25 award or continue the bonus event and play the second round. In this example, the central controller offers $25 to each of the ten players to quit the bonus event. If one player chooses to quit after the first round, the central controller provides that player (or causes that player to be provided) with the $25 award. Accordingly, nine players chose to play the second round of the bonus event. In the second round, three players pick the designated selection. In such an instance, the central controller offers a total award of $75 (i.e., $25 from the first round and $50 from the second round) to each of the three players to quit the bonus event. In this instance, the players eliminated in the second round (e.g., six players) forfeit or lose any awards previously accumulated in the bonus event (e.g., the $25 award from the first round). Accordingly, the three players may quit the bonus event and accept the $75 award or the three players may continue to play the third round of the bonus event. The bonus event continues in this manner until reaching a round in which a designated number of players, e.g., one player, selects the designated selection (i.e., a final round). In this example, the central controller provides any player who selected the designated selection in the third round with a total award of $275 (i.e., $25 from the first round, $50 from the second round and $200 from the third round).

In one embodiment, players who are eliminated from the bonus event keep any awards accumulated from previous rounds (i.e., the rounds prior to the player being eliminated). For example, the designated selection in a first round may be associated with a low additional award, such as $10, while the designated selection in a second round may be associated with a higher additional award, such as $25. In this example, if four hundred players pick the designated selection in the first round, the central controller provides each of those players with the additional award (e.g., $10) and advances those players to the second round. If two hundred of these players do not pick the designated selection in the second round, the central controller provides these players with the additional award (e.g., $10) from picking the designated selection in the first round and eliminates these players from the bonus event. Such a configuration enables the players to play one or more subsequent rounds in the bonus event without risking any additional awards won in a previous round. This increases excitement and enjoyment for the players.

In one alternative embodiment, the central controller is operable to maintain at least one award pool for each round of the bonus event. The central controller provides a portion of the award pool (or causes a portion of the award pool to be provided) to each player who picked the designated selection in one of the rounds. If one player picks the designated selection in one of the rounds, that player is provided with the entire award pool. If a plurality of players pick the designated selection in one of the rounds, those players are provided with respective portions of the award pool (i.e., the award pool is split between these players). In one embodiment, the bonus event is associated with a primary award pool and each round is associated with a secondary award pool. The secondary award pools may collectively form the primary award pool. For example, in a two round bonus event with 10 players, the primary award pool may be $200. In this example, the first and second rounds may each be associated with a portion (e.g., $100) of the primary award pool. Alternatively, a first round may be associated with a lower portion of the award pool than a second round.

In another alternative embodiment, the central controller ends the bonus event when none of the players pick the designated selection (or make an input associated with a designated outcome, such as a winning outcome) in one of the rounds. If the bonus event has ten rounds, and none of the players pick the designated selection in a fourth round, the central controller ends the bonus event in the fourth round regardless of the number of rounds in the bonus event. For example, the central controller provides an initial round to twenty players. The twenty players pick selections from a number of available selections in the initial round. If two players pick the designated selection, those two players are eligible for a second round. In the second round, the two eligible players pick selections from a number of available selections. If neither player picks the designated selection, the central controller determines that neither player is eligible for a third round and ends the bonus event. In such an instance, the award is provided to the player (or shared by a plurality of players) who picked the designated selection in the round immediately preceding the third round (i.e., the second round). That is, if no players advance to a final round, the award will be divided or split among the players who picked the designated selection in a previous round (i.e., the round immediately preceding the final round). In this example, the award is shared by the two players who picked the designated selection in the second round.

In another embodiment, if no players advance to a final round, the bonus event ends and the award is provided in a subsequent bonus event. In one such embodiment, the subsequent bonus event is provided at a different frequency and/or at different odds than the initial bonus event. In one instance, the subsequent bonus event occurs more frequently and provides players with a higher likelihood of winning the award, which provides increased excitement and enjoyment for players. Additionally, the award may grow to a relatively large amount because the award can be carried over to one or more subsequent bonus events and continually funded (e.g., by player's wagers). This provides increased excitement and enjoyment for the players.

In another embodiment, the central controller ends the bonus event when none of the players pick the designated selection in one of the rounds and provides players with an additional award for picking the designated selection in previous rounds. In this embodiment, each time one of the players picks the designated selection in one of the rounds, the central controller provides those players (or causes those players to be provided) with an additional award for that pick. If none of the players pick the designated selection in one of the rounds, the central controller determines that none of the players are eligible for another round and ends the bonus event. In such an instance, the central controller provides any additional awards accrued by each of the players for picking the designated selections in previous rounds to those players. That is, the central controller provides the additional accumulated awards to players based on their picks from previous rounds regardless of when those players are eliminated from the bonus event. In this embodiment, the central controller also provides the award associated with the bonus event to the player (or players if shared by a plurality of players) who pick the designated selection in the round immediately preceding the last round (i.e., the round in which none of the players picked the designated selection). For example, if four hundred players pick the designated selection in a first round, the central controller provides each of the four hundred players an additional award (e.g., $2) and advances these players to a second round. If two hundred of these players do not pick the designated selection in the second round, the central controller provides these two hundred players with the additional award (e.g., $2) from picking the designated selection in the first round and eliminates these players from the bonus event.

Accordingly, one advantage of the gaming system and method disclosed herein is to provide a bonus event to a plurality of players at substantially the same time, wherein choices and input of the players in the bonus event affects the outcome of the bonus event. This provides increased excitement and enjoyment for players.

Another advantage of the gaming system and method disclosed herein is to provide a central controller or server that defines one or more awards for a bonus event without selecting a winning player for those awards. The winning player is selected through choices and input from the players during the bonus event. This provides increased excitement and enjoyment for the players.

Another advantage of the gaming system and method disclosed herein is to associate each eligible player with a portion of the award for a bonus event. This portion of the award represents an award share for each eligible player. As players are eliminated from the bonus event, the award share associated with each eligible player increases. This provides increased potential awards for the players, which increases excitement and enjoyment for the players.

Other objects, features and advantages of the disclosure will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 4 is a chart showing one embodiment of a multi-round bonus event, wherein a plurality of players compete for an award at substantially the same time and only one of the players wins the award.

FIG. 5 is a chart showing one embodiment of a multi-round bonus event, wherein a plurality of players compete for an award at substantially the same time and a plurality of the players win the award.

FIGS. 6A and 6B are charts of one embodiment of a multi-round bonus event, wherein a plurality of players compete for an award at substantially the same time and the award is provided to one or more players in a round that precedes a final round.

FIG. 7 is a chart of one embodiment of a multi-round bonus event, wherein a plurality of players compete for an award at substantially the same time and the bonus event includes an offer and acceptance feature.

FIG. 8 is a chart of one embodiment of a multi-round bonus event, wherein a plurality of players compete for an award at substantially the same time and each round is associated with a different award.

FIGS. 9A and 9B are charts of one embodiment of a multi-round bonus event, wherein a plurality of players compete for an award at substantially the same time and the award is provided to one or more players in a round that precedes a final round.

DETAILED DESCRIPTION

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
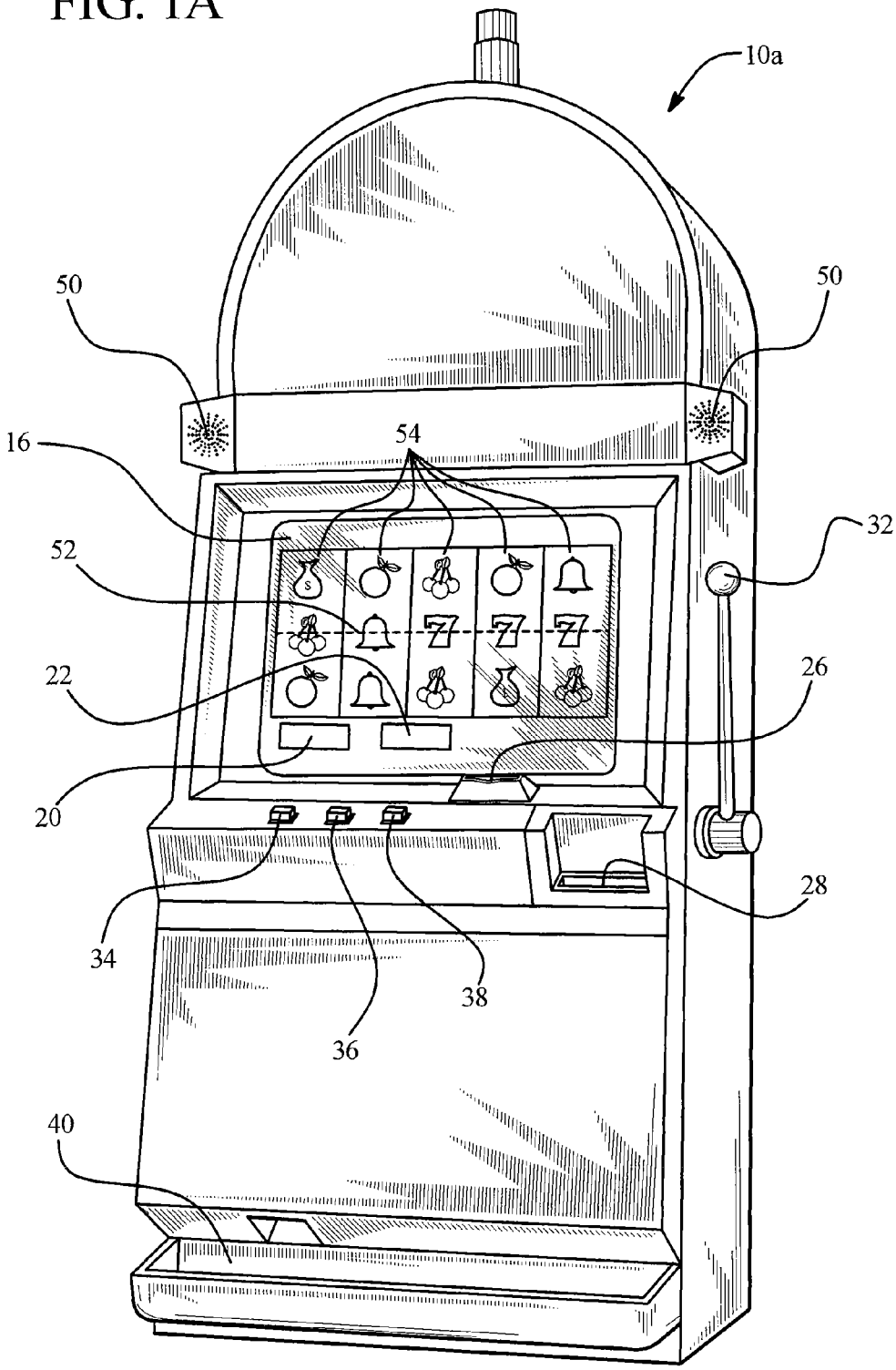
FIG. 1A is a front-side perspective view of one embodiment of the gaming device disclosed herein.
Figure 1B:
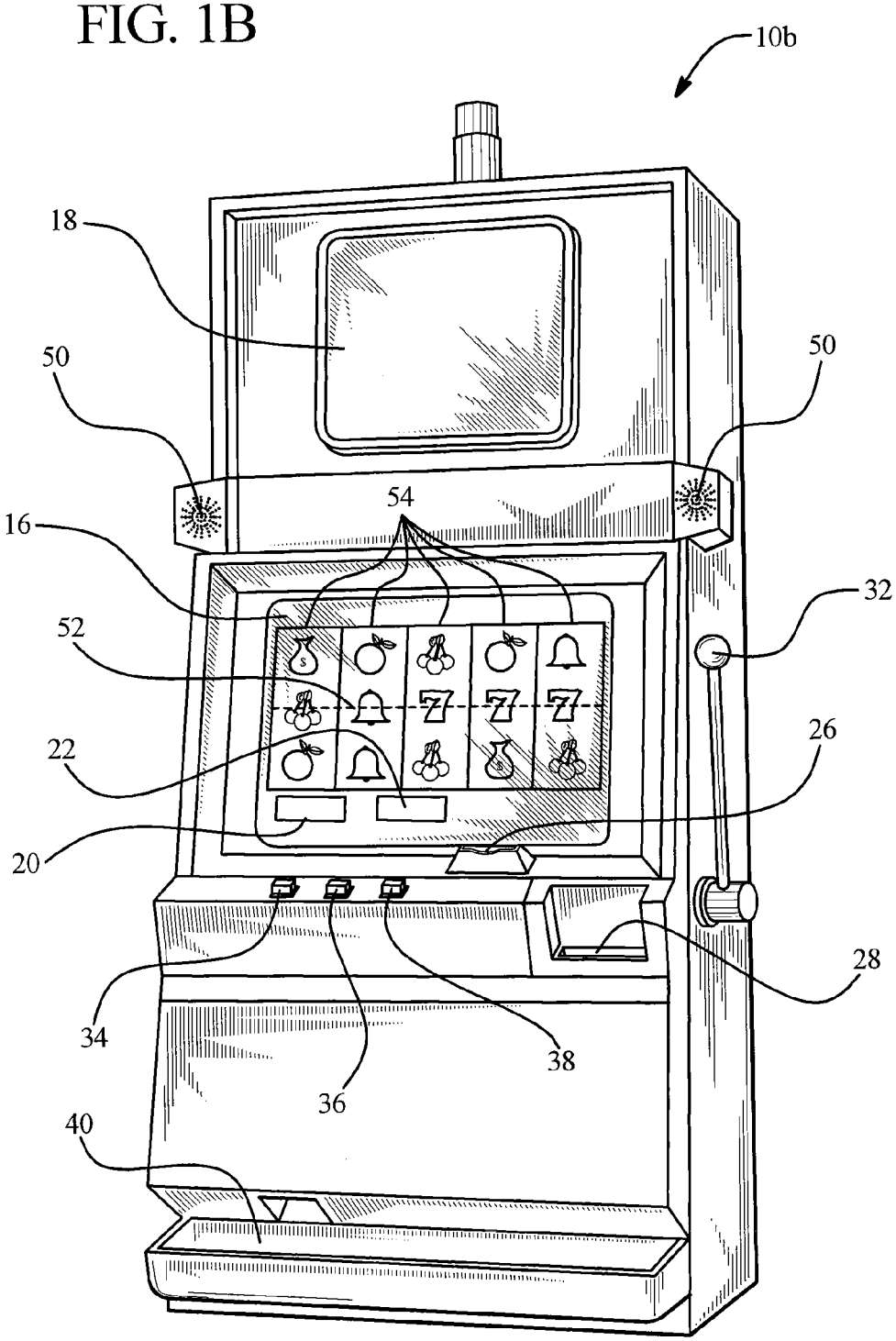
FIG. 1B is a front-side perspective view of another embodiment of the gaming device disclosed herein.

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
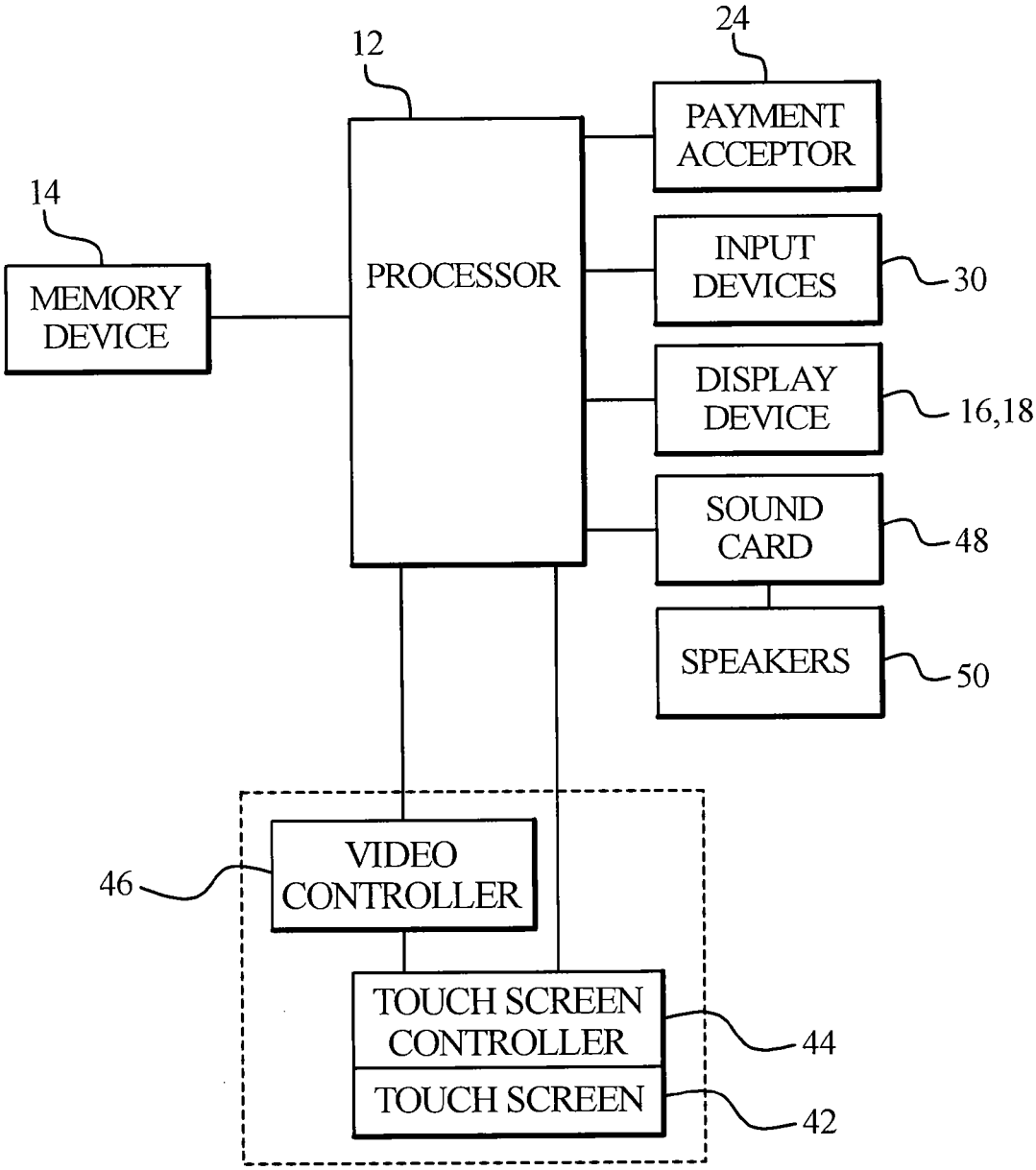
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel. The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
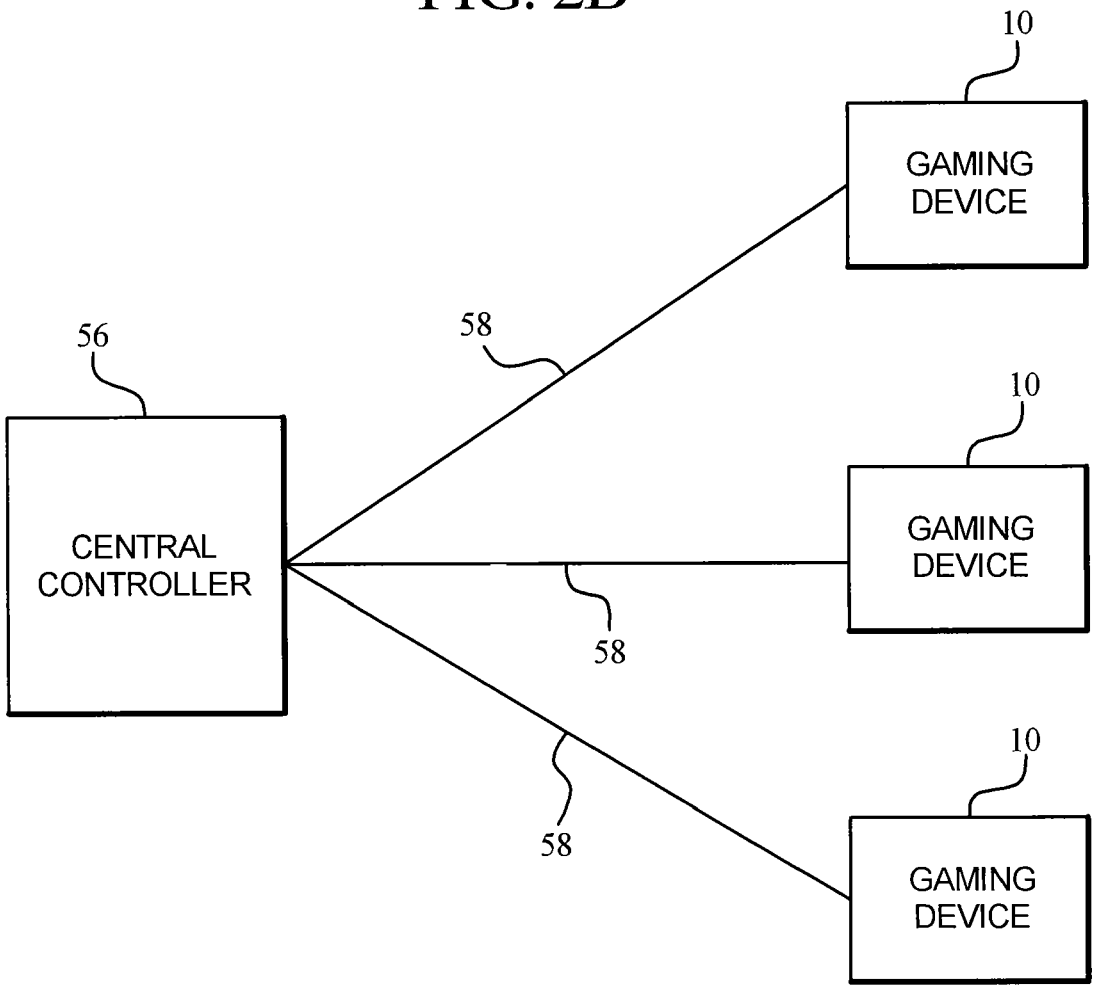
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices. In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Multi-Round Bonus Event

One embodiment of the gaming system and method disclosed herein substantially simultaneously provides a multi-round bonus event to a plurality of players. Each player's input determines, at least in part, an award, if any, provided to that player for the bonus event. The bonus event may be any bonus or secondary game or sequence. For example, in different embodiments, the bonus event includes, but is not limited to, reel/slot games, card games (e.g., poker, blackjack), lottery games, selection games, offer and acceptance games, wheel games, dice games, free spin games, competition games, skill games, perceived skill games or games that include one or more rounds of game play.

Upon an occurrence of a suitable triggering event, the central controller of the gaming system identifies at least one player and preferably a plurality of players who are eligible to play the bonus event. In one embodiment, the central controller identifies (or causes the identification of) one or more eligible players at gaming machines in the gaming system. The central controller causes a display device of a plurality of gaming machines to display the bonus event to those eligible players. That is, the central controller enables one or more eligible players at gaming machines in the gaming system to substantially simultaneously attempt to win the award in the bonus event, wherein the award or outcome of the bonus event is determined, at least in part, by player input, choices or decisions in the bonus event. It should be appreciated that the eligibility of the players at gaming machines in the gaming system may be displayed on a display device of the gaming machines or another display device associated with those gaming machines, such as a player tracking display screen or any other suitable display device.

In one embodiment, the central controller determines to provide the bonus event upon an occurrence of a triggering event or qualifying condition. In one embodiment, the triggering event or qualifying condition occurs based on a play of a game. For example, the triggering event or qualifying condition is a symbol-driven event, such as a generated symbol or symbol combination in a primary game of one of the gaming machines in the gaming system. In another embodiment, the triggering event or qualifying condition may occur by exceeding a certain amount of game play (number of games, number of credits, amount of time) or reaching a specified number of points earned during game play. For example, the triggering event may occur during a predetermined period of time, such as a bonus qualification period. In an alternative embodiment, the triggering event or qualifying condition occurs randomly and independent of game play. In different embodiments, the triggering event or qualifying condition is predetermined, randomly determined, determined or weighted based on the player's wager, determined or weighted based on the status of one or more players (such as determined through a player tracking system), determined based on time, or determined based on any other suitable parameter or function.

In one embodiment, a plurality of gaming devices in the gaming system provides one or more bonus events to the players of the gaming system upon the occurrence of a triggering event. In this embodiment, the triggering event is triggered by an event in or based on any of the plays of any primary game or on any of the plays of any secondary game of a plurality of gaming devices in the gaming system. For example, the triggering event is caused by a random occurrence of a predetermined symbol or a predetermined combination of symbols (e.g., a symbol combination including a plurality of bonus symbols) generated in a play of the primary game. That is, the triggering event is a symbol driven event which is readily apparent to the players.

In one embodiment, a plurality of gaming devices in the gaming system does not make the triggering event for obtaining one or more bonus events readily apparent to the players of the gaming system. That is, the triggering event is a mystery event which is not readily apparent to the players. In one such embodiment, the triggering event is caused by a random trigger number selected from a range of numbers. When a game on one of the gaming devices in the gaming system is commenced, each game/player is allotted numbers from the same number range from which the random number was selected. That is, prior to each primary game, the central server and/or individual gaming device processor selects a random number from a range of numbers and during each primary game, the central server and/or individual gaming device processor allocates N number(s) in the range to the plurality of players. The previously selected random number is compared with the N number(s) allotted to the player(s). If there is a match between the trigger number and one of the player's allotted numbers, the central server and/or individual gaming device processor determines that the triggering event will occur and causes the triggering event to occur.

In one embodiment, the triggering event is caused by a random trigger number selected from a range of numbers. When the game is commenced, each game/player is allotted numbers from the same number range from which the random number was selected. One number in the range is allotted for each credit bet such that the player's probability of being awarded any award(s) is proportional to the wager amount. That is, prior to each primary game, the central server and/or individual gaming device processor selects a random number from a range of numbers and during each primary game, the central server and/or individual gaming device processor allocates the first N numbers in the range to each player, where N is the number of credits bet by the player in that primary game. The previously selected random number is compared with the N numbers allotted to the player(s). If there is a match between the trigger number and one of the player's allotted numbers, the central server and/or individual gaming device processor determines that the triggering event will occur and causes the triggering event to occur.

In one embodiment, the central server and/or individual gaming device processor maintains one or more trigger values that are each associated with a separate range of values. In this embodiment, a triggering event will occur when the trigger value increments or increases to a value (i.e., a trigger hit value) within the range of values associated with that trigger value. For example, a triggering event will occur when the trigger value for a total wagered amount or a total coin-in increments to a trigger hit value of $500. In another example, a triggering event will occur when the trigger value reaches a designated time, such as 9:00 pm. The trigger hit values can be randomly selected, predetermined or otherwise determined by the implementer or operator of the gaming system.

In one embodiment, once the central controller determines that a suitable triggering event has occurred, the central controller determines which system gaming machines will provide the bonus event. The central controller designates players at these gaming machines as eligible players. Such a determination is based in part on the individual status of each of the gaming machines in the gaming system. That is, the individual status of each gaming machine determines whether the player of that gaming machine is eligible to play in the bonus event.

In one embodiment, each gaming machine is determined to be in either active or enrolled status. Active status means that the gaming machine is being actively played by a player during a certain time period, such as a bonus event qualification period. The active status requirements can be based on any suitable number of satisfied criteria or defined in any suitable manner by the implementer of the gaming system disclosed herein. For instance, the existence of a player tracking card in the gaming machine may be part of the determination of whether that gaming machine is in the active status. Other factors such as: (a) the amount of time between each play of or wager on the primary game of the gaming machine; (b) the amount being wagered on the primary game(s); (c) the number of plays within a period of time; (d) the existence of credits on the gaming machine and (e) a play of or a wager on the primary game of the gaming machine within a predetermined period of time may also or alternatively be part of the determination of whether a gaming machine is in the active status. On the other hand, the enrolled status means that the gaming machine is one of the gaming machines in the gaming system, but is not in the active status (i.e., not being actively played by a player according to one or more of the predetermined criteria) during the certain time period, such as a bonus event qualification period.

In one embodiment, once the central controller detects an occurrence of a suitable triggering event, the central controller determines which players are eligible for the bonus event in association with a suitable player tracking system. In this embodiment, the player tracking system and/or central controller timely tracks when a player inserts their playing tracking card (i.e., Card In) to begin playing at one of the gaming machines in the gaming system. The player tracking system and/or central controller also timely tracks when a player removes their player tracking card (i.e., Card Out) when concluding play at one of these gaming machines. By this tracking, the central controller is operable to determine which players of the gaming machines in the gaming system are eligible for the bonus event. It should be appreciated that players may be identified and determined to be eligible in any suitable manner in association with a player tracking system. For example, instead of tracking Card In/Card Out, the player tracking system and/or central controller could track when a player logs into and logs out of the player tracking system using security codes, such as username, password and/or PIN number.

In one embodiment, the central controller determines which players are eligible for the bonus event in association with a separate wager. The separate wager comprises a side-wager or entry fee that enables a player to participate in the bonus event. In one embodiment, players who logged into a suitable player tracking system (e.g., either with a player tracking card or in another manner) and players who buy into the bonus event by placing a separate wager are eligible for the bonus event. In one embodiment, any separate wagers placed to participate in the bonus event fund one or more awards or award pools of the bonus event.

Once a suitable triggering event occurs, the central controller substantially simultaneously provides a multi-round bonus event to at least one and preferably each eligible player. In one embodiment, the bonus event is a multi-round selection game that includes a plurality of rounds and a number of available outcomes in each round. In one embodiment, the players must pick a designated outcome (i.e., a winning outcome) in each round to win all or a share of an award associated with the bonus event. For example, the multi-round selection game includes four rounds and ten outcomes per round. If at least one of the players picks (or makes an input associated with) the designated outcome in a first round, that player advances to a second round. In the second round, the advancing players make an input in association with, or from, a plurality of available outcomes in an attempt to advance to a third round. In the third round, the advancing players pick from a plurality of available outcomes in an attempt to advance to a final round During any of the plurality of rounds, once a player does not make an input associated with the designated selection, that player is eliminated from the bonus event and is disqualified from winning the award. If none of the players reach the final round, the central controller ends the bonus event (or causes the bonus event to end). In the final round, the central controller causes the gaming machines to provide a number of available outcomes to each player that reaches the final round. If one or more of the players make an input associated with the designated outcome (i.e., a winning outcome) in the final round, the central controller provides the award (or causes the award to be provided) to those one or more players. In one embodiment, the award is divided or split among a plurality of the players if a plurality of players pick the designated selection in the final round. The award may be shared, either equally or based on any suitable criteria, amongst the plurality of players who picked the designated outcome in the final round.

In one embodiment, the odds of winning the award are based on the number of rounds in the bonus event and the number of available outcomes per round. For example, if the award has a $1/100{,}000$ odds of winning, the bonus event may include five rounds with ten available outcomes in each round. In this example, each player has a X in Y chance to select the designated outcome in each round, wherein X is equal to the number of designated outcomes in the round and Y is equal to the number of available outcomes in the round. If each of five rounds has one designated outcome and ten available outcomes, each player would have a $1/10$ chance to select the designated outcome in any given round. The player has a $(1/10)\times(1/10)\times(1/10)\times(1/10)\times(1/10)=1/100{,}000$ chance of picking the designated outcome in each of the five rounds. It should be appreciated that the number of designated outcomes and the number of available outcomes can be any suitable numbers determined by the implementer of the gaming system.

In one embodiment, the central controller determines one or more eligible players for the bonus event in association with a player tracking system. In this embodiment, the player tracking system and/or central controller timely tracks when a player inserts their playing tracking card (i.e., Card In) to begin playing at one the gaming machines in the gaming system disclosed herein. The player tracking system and/or central controller also timely tracks when a player removes their player tracking card (i.e., Card Out) when concluding play at one of these gaming machines. By this tracking, the gaming system disclosed herein does not enable players at an un-carded gaming device to participate in the bonus event. Similarly, players who begin playing empty gaming machines are not enabled to participate in the bonus event. In one embodiment, upon card-in, if the player is playing an enrolled gaming machine, the central controller designates that player as eligible for a bonus event. In one embodiment, the gaming system and/or the gaming machines display a message to the players regarding their eligibility or ineligibility. For example, a player can change wagers, change the number of coins wagered, and even change games played and still remain eligible for the bonus event as long as these players remain enrolled at one of the gaming machines in the gaming system.

Figure 3:
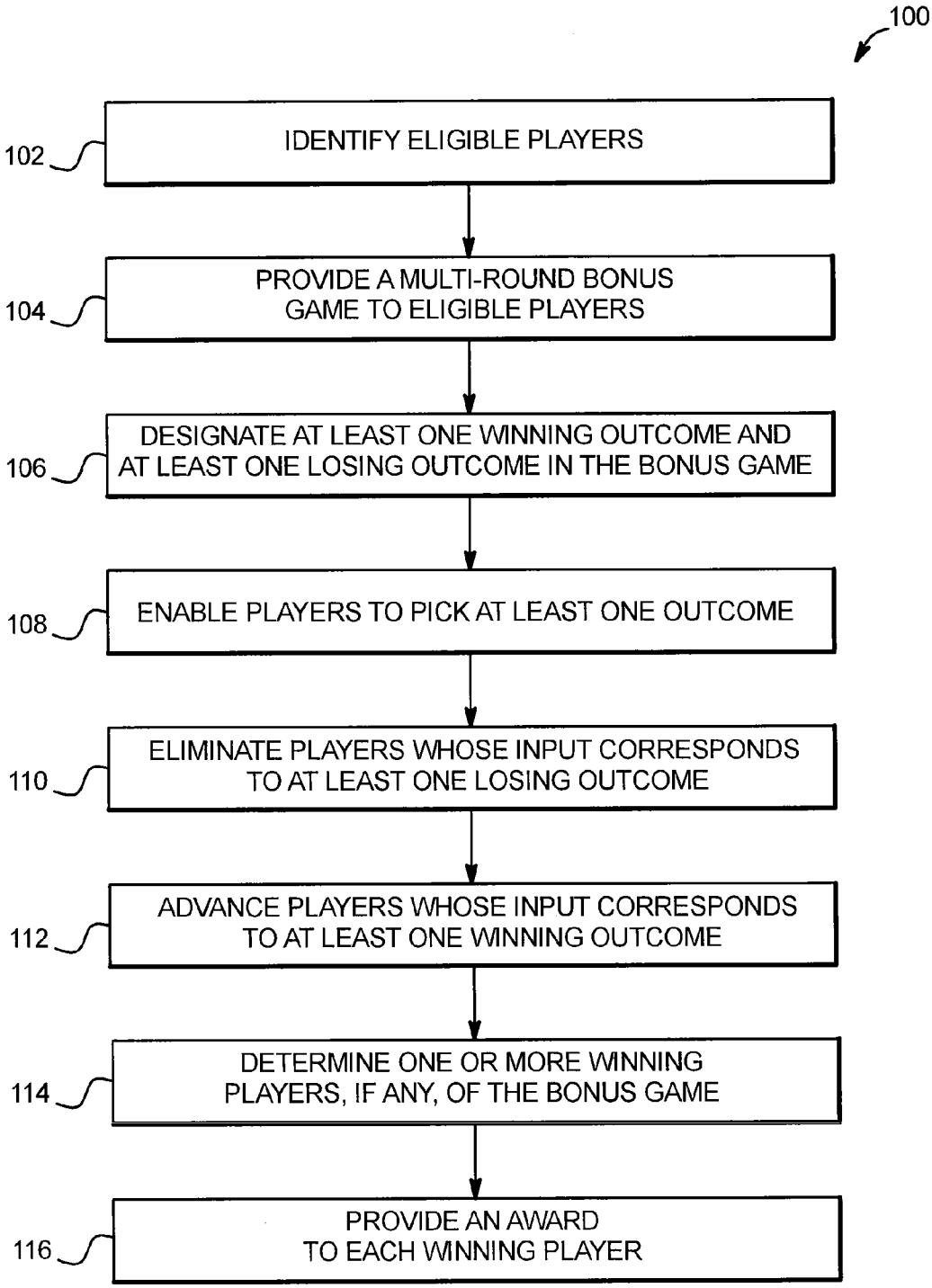
FIG. 3 is a flowchart of one embodiment of the gaming system disclosed herein illustrating an opportunity for one or more players to win an award in a bonus event.

Referring now to FIG. 3, a flowchart of an example process 100 for substantially simultaneously providing a bonus event to a plurality of eligible players is illustrated. In one embodiment, the process 100 is embodied in one or more software programs stored in one or more memories and executable by one or more processors, such as the central controller of the gaming system. Although the process 100 is described with reference to the flowchart illustrated in FIG. 3, it should be appreciated that many other methods of performing the acts associated with process 100 may be used. For example, the order of many of the blocks may be changed, and many of the blocks described may be optional.

In one embodiment, the process 100 is embodied in computerized instructions executed by a central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the process 100 is embodied in computerized instructions which are communicated from the central controller or remote host to a gaming device local processor and memory devices. In such a "thick client" embodiment, the gaming device local processor executes the communicated computerized instructions to control any games (or other suitable interfaces) provided to a player.

Generally, the process 100 enables a central controller to cause the system gaming machine to provide a multi-round bonus event to a plurality of players. Each players' input determines, at least in part, an award, if any, provided to that player for the bonus event. Upon an occurrence of a suitable triggering event, the central controller identifies (or causes an identification of) at least one player and preferably a plurality of players who are eligible for the multi-round bonus event as indicated by block 102. In one embodiment, the eligible players include each player enrolled at one of the gaming machines in the gaming system.

In one embodiment, the central controller determines which players of the gaming machines in the gaming system are eligible for the multi-round bonus event by tracking when players insert their player tracking card into (and remove their player tracking card from) one of the gaming machines in the gaming system. In another embodiment, the central controller determines which players of the gaming machines in the gaming system are eligible for the bonus event by determining which system gaming machines will provide the bonus event and designating the players at these system gaming machines as eligible players.

The central controller provides the multi-round bonus event (or causes the gaming machines to provide the multi-round bonus event) to those eligible players as indicated by block 104. That is, the central controller enables one or more eligible players in the gaming system to substantially simultaneously attempt to win the award in the multi-round bonus event, wherein the award or outcome of the multi-round bonus event is determined, at least in part, by player input, choices or decisions in the bonus event. It should be appreciated that the central controller may provide the bonus event (or cause the gaming machines to provide the bonus event) to a plurality of or each of the eligible players and/or gaming machines.

In different embodiments, the multi-round bonus event includes, but is not limited to, reel/slot games, card games (e.g., poker, blackjack), lottery games, selection games, offer and acceptance games, wheel games, dice games, free spin games, competition games, skill games, perceived skill games or games that include one or more rounds of game play. In one embodiment, the same multi-round bonus event is provided to the eligible players. In another embodiment, each eligible player is provided with the same multi-round bonus event, but each available outcome and each designated outcome is independently and randomly determined for each player. In another embodiment, the eligible players are provided with different types of multi-round bonus events based on player preferences of which type of multi-round bonus event each player wants to play. In another embodiment, each eligible player is provided either the same or different types of multi-round bonus event, wherein the difficulty of the multi-round bonus event is adjusted based on some predetermined criteria, such as player wager amount in the primary game or a player status determined through a suitable player tracking system.

The multi-round bonus event includes a plurality of outcomes in each round. Each round may include the same number of or different numbers of outcomes. At least one of the outcomes is designated as a winning outcome and at least one of the outcomes is designated as a losing outcome as indicated by block 106. In one embodiment, each round includes one winning outcome and a plurality of losing outcomes. The number of outcomes, the number of rounds, and/or the number of winning or designated outcomes are set to any suitable number by the implementer of the gaming system. In one embodiment, the bonus event includes a selection game and the plurality of outcomes include player selectable elements or selections.

The central controller enables each eligible player to make an input in association with the plurality of outcomes in each round as indicated by block 108. In one embodiment, the central controller enables each player to pick at least one of the selections via any suitable input device of the gaming machine, such as a touch screen. The central controller receives a signal from gaming machines in the gaming system corresponding to an input from each player in each round. Based on the players' input, the central controller designates (or causes a designation of) certain players to be ineligible (i.e., if the player's input is associated with the losing outcome) and eliminates (or causes an elimination of) those players from the bonus event as indicated by block 110. That is, when one or more of the players are deemed ineligible for one of the rounds, the central controller eliminates those players from the bonus event. For example, the bonus event may include a selection bonus game. In this example, the selection bonus game includes a plurality of rounds, a plurality of selections in each round and at least one designated selection (i.e., a winning outcome) in each round. During play of the selection bonus game, players who do not pick the designated selection (i.e., a winning outcome) in an initial round may be deemed ineligible for a subsequent round.

Based on the players' input, the central controller designates (or causes a designation of) certain players to advance to a subsequent round as indicated by block 112. That is, when one or more of the players make an input that is associated with the winning outcome in one of the rounds, the central controller advances these players to a subsequent round of the bonus event. For example, the bonus event may include a selection bonus game. In this example, the selection bonus game includes a plurality of rounds, a plurality of selections in each round and at least one designated selection (i.e., a winning outcome) in each round. During play of the selection bonus game, players who pick the designated selection (i.e., a winning outcome) in an initial round may be deemed eligible for advancement to a subsequent round. That is, only eligible players may advance to the subsequent round of the bonus event.

In one embodiment, if a player does not make an input associated with the designated selection (i.e., a winning outcome) in an initial round, that player may be deemed ineligible for advancement to a subsequent round. In one embodiment, at least one anti-terminator may be provided to the player to enable the player to either advance to the subsequent round of the bonus event or make another input in the initial round of the bonus event in an attempt to pick the designated selection (i.e., the winning outcome).

This process continues for a designated number of rounds until a final round. In the final round, the central controller determines one or more winning players, if any, of the bonus event as indicated by block 114. In one embodiment, the process continues until a designated number of winning players, such as one or a plurality of players, is determined for the bonus event. In one embodiment, the final round is determined as the round in which a designated number of players remain in the bonus event. In various embodiments, these designated numbers may be one, two or any other suitable number. For a multi-round selection game that includes four rounds and ten selections per round, the central controller may determine the winning player to be any player who picked a designated selection in each of the first, second, third and fourth rounds.

In one embodiment, independent of how the winning players are determined, the central controller is operable to provide an award to each winning player as indicated by block 116. For example, in a final round of a bonus event, if one of the eligible players makes an input associated with the winning outcome, the central controller provides that player with the award. In one embodiment, if a plurality of the eligible players make an input associated with the winning outcome, the central controller provides each of these players with the award (or a portion of the award if a plurality of players make inputs associated with the winning outcome). For instance, if ten players advance to a final round of a bonus event associated with an award of $50,000 and only two of the players make inputs associated with the winning outcome in the final round, the central controller provides each of these two players with $25,000. In this instance, the award was shared equally between the two players. In another embodiment, the award is shared disproportionately based on any suitable criteria, such as wager amount in a primary game provided by the gaming machines or a player status (as determined through a player tracking system). In one embodiment, if none of the eligible players make an input associated with the winning outcome, the central controller provides a subsequent bonus event to the eligible players. The subsequent bonus event may be provided to the players with different odds to increase the likelihood of at least one of the players winning the award.

FIG. 4 is a chart showing one embodiment of a multi-round bonus event, wherein a plurality of players compete for an award at substantially the same time and only one of the players wins the award. As illustrated, the multi-round bonus event includes ten rounds and eight hundred players qualify for or are eligible for the bonus event. The eight hundred eligible players compete against one another to win an award of $50,000.

During the bonus event, some of the eight hundred players advance to a second round and some of the eight hundred players are eliminated from the bonus event. As illustrated, four hundred players advance to a second round, such as by making an input associated with the winning outcome in the first round. In this embodiment, players continue to advance or be eliminated until a tenth or final round of the bonus event. In an alternative embodiment, players continue to advance or be eliminated until a predetermined number of players, such as one player or a plurality of players, advances to a given round.

As illustrated, two eligible players advanced to the tenth round. In the tenth round, each eligible player has an opportunity to win the $50,000 award. Only one of the eligible players advanced in the final round (i.e., made an input associated with the winning outcome in the final round). The central controller designated the player who advanced in the final round as the winning player. Accordingly, the central controller provides the winning player with the $50,000 award.

In another embodiment, as shown in FIG. 5, a multi-round bonus event includes five rounds and eight hundred players qualify for or are eligible for the bonus event. The eight hundred eligible players compete against one another to win all or a portion of an award of $100,000. Players continue to advance or be eliminated in each round until a fifth round, which is the final round of the bonus event in this embodiment. As illustrated, twenty five eligible players advanced to the fifth or final round, wherein each eligible player has an opportunity to win or share the $100,000 award. Five players advanced in the final round (i.e., made inputs associated with the winning outcome). The central controller designates (or causes a designation of) the players who advanced in the final round as the winning players. In this embodiment, each of the five players who advanced in the final round win an equal portion of the award. Accordingly, in this embodiment, each of the five players wins an award of $20,000 or ⅕ of the $100,000 award. The central controller provides the $20,000 award to each winning player (or causes the award to be provided to each winning player).

In one alternative embodiment, none of the eligible players in the final round advance from the final round (i.e., make inputs associated with the winning outcome in the final round). For example, as shown in FIGS. 6A and 6B, a multi-round bonus event includes five rounds and eight hundred players qualify for or are eligible for the bonus event. The eight hundred eligible players compete against one another to win an award of $100,000. Players continue to advance or be eliminated in each round until a fifth round, which is the final round of the bonus event in this embodiment. As illustrated in FIG. 6A, five eligible players advanced to the fifth or final round. In the fifth round, the central controller enables the five players to make an input and determines whether the players' input is associated with the winning outcome or the losing outcome. In this embodiment, none of these five players advance in the final round (i.e., made an input associated with the winning outcome). That is, all five players who advanced to the fifth or final round made an input associated with a losing outcome in the final round. Thus, none of the five players win the award or a portion of the award in the fifth or final round. In this embodiment, the central controller designates (or causes a designation of) the players who advanced in the round immediately preceding the final round as the winning players as shown in FIG. 6B. That is, the central controller designates the players who advanced to the final round as winning players. In this embodiment, each of the five players who advanced to the final round win a portion of the $100,000 total award, such as $20,000 or ⅕ of the $100,000 award. After determining the portion of the award for each winning player, the central controller provides the respective portions of the $100,000 award (or causes the respective portions of the award to be provided) to the winning players.

In another alternative embodiment, if the central controller determines that none of the eligible players win the award or a portion of the award in the final round, the central controller is programmed to provide that award in a different bonus event. In this instance, the central controller may change the triggering event and/or the odds for the different bonus event to increase each eligible player's likelihood of winning the award. For example, a central controller determines that a first triggering event associated with a first bonus event will occur in the next thirty days (i.e., a bonus qualification period). If on the seventh day, the bonus event is initiated or triggered and no players win the award (or a portion thereof) in that bonus event, the central controller associates a second triggering event with the bonus event. In this example, the central controller determines that the second triggering event will occur in the next twenty-three days. Thus, the central controller determined to shorten the bonus qualification period, which enables the central controller to provide the bonus event (or cause the bonus event to be provided) more often. In another embodiment, the central controller may change the odds of the bonus event so that players have a better chance of winning the award. For example, in a selection bonus game, the central controller may change a number of selections, a number of rounds and/or a number of designated selections to control the odds of each bonus event. In an additional embodiment, the central controller determines to shorten the bonus qualification period and change the odds of the bonus event. In this embodiment, the bonus event is provided to eligible players more often and when provided, the eligible players have a higher chance of winning an award in the bonus event. It should be appreciated that the eligible players for the second or subsequent bonus event may include the eligible players from the first bonus event, newly eligible players for the second or subsequent bonus event (who were not eligible for the first bonus event), or any combination thereof.

In one embodiment, the gaming system communicates this information to the players through appropriate messages, such as "NO PLAYER WON THIS ROUND. KEEP PLAYING FOR ANOTHER CHANCE AT THE AWARD. IN THE NEXT BONUS EVENT, THERE WILL BE ONLY SEVEN ROUNDS TO WIN THE AWARD!!" so the players know that the award is available and/or the odds of the bonus event have changed. Such messages may motivate certain players to continue to play or to play at a faster rate.

FIG. 7 is a chart of one embodiment of a multi-round bonus event, wherein a plurality of players compete for an award at substantially the same time and the bonus event includes an offer and acceptance feature. In this embodiment, the multi-round bonus event includes five rounds. Each round is associated with an award, such as $10,000. As illustrated, eight hundred players are eligible for the bonus event in this embodiment. Of the eight hundred players, four hundred players qualified to advance from the first round to a second round (i.e., by making an input associated with the winning outcome in the first round). Prior to the second round, the central controller offers each advancing player an additional award to quit the bonus event. For example, since four hundred players advanced to the second round, the additional award for the first round would be equal to $25 for each advancing player (i.e., the total amount of the award, such as $10,000, divided by the number of advancing players, such as 400). As illustrated, one hundred players who qualified to advance to the second round, accepted the offered additional award and quit the bonus event. Three hundred player who qualified for the second round rejected the offered additional award and continue to the second round of the bonus event.

In the second round, two hundred players qualify to advance to the third round. The central controller offers those players to either quit the bonus event and accept the second additional award or continue the bonus event and play the third round. The second additional award offered to each advancing player is $50 (i.e., the total amount of the award, such as $10,000, divided by the number of advancing players, such as 200). The central controller offers the second additional award to each of the two hundred players who qualified to advance to the third round. In this embodiment, one hundred players chose to quit and accept the offered second additional award, such as $50. The central controller provides those players with the second additional award and eliminates those players from the bonus event. Accordingly, one hundred players rejected the offered second additional award and continue to the third round of the bonus event.

As illustrated, this process continues for each round until the central controller determines one or more winning players for the bonus event. In one embodiment, each player is required to make an input associated with the winning outcome in each round including the final round to be determined as a winning player. The central controller provides the winning player or players the additional award associated with the final round of the bonus event.

In one embodiment, the additional awards accumulate as the players advance through each round of the bonus event. For example, as illustrated, the total accumulated award for the second round (e.g., $75) equals the amount won by each advancing player in the first and second rounds (e.g., $25 and $50, respectively). In this embodiment, if a player chooses to continue the bonus event and does not advance in a subsequent round, that player loses or forfeits any additional awards accumulated in the bonus event. The total accumulated award for each round is offered to each advancing player along with the option to quit the bonus event. In one embodiment, as illustrated, the total accumulated award offered to the players increases with each round. It should be appreciated that the award values associated with each round may be set to any suitable values by the implementer of the gaming system. In one embodiment, the awards associated with each round include bonus awards or progressive awards. In one such embodiment, each round is associated with a different level of a multi-level progressive configuration (MLP).

In one embodiment, the central controller provides a consolation award (or causes the consolation award to be provided) to each player who did not pick the designated outcome in one of the rounds. That is, in one embodiment, the additional award (or a portion of the award) associated with each round may be a consolation award provided to players who do not advance to a subsequent round.

In one embodiment, the central controller is operable to maintain at least one award pool for each bonus event. The central controller offers a portion of the award pool (or causes a portion of the award pool to be offered) to each player who picked the designated selection in one of the rounds. If a player accepts the offered portion of the award pool, the player is eliminated from the bonus event (i.e., the player accepts the offered portion of the award pool in exchange for quitting the bonus event). If a player rejects the offered portion of the award, that player risks the offered portion of the award to play a subsequent round of the bonus event. For example, an award pool having a value of $1000 may be associated with a first round of the bonus event. In this example, one hundred eligible players advance from the first round by making an input of a designated or winning outcome in the first round. Each of the one hundred advancing players is thus associated with $10 of the $1000 award pool (e.g., $1000 award pool/100 players=$10 portion for each advancing player). The central controller may cause the display device to display an offer of $10 to the advancing players. The display may include appropriate messages, such as "YOU HAVE WON $10 FOR ROUND 1! YOU MAY QUIT THE BONUS EVENT AND KEEP THE $10 OR RISK THE $10 AND PLAY ANOTHER ROUND!" If fifty players accept the offer and quit the bonus event, the central controller provides these fifty players with an award portion of $10. The award pool decreases in value based on the number of players who accept the offered portion of the award pool. For example, since fifty players accepted the offer, the award pool decreases to a value of $500 (e.g., $1000−(50 players×$10) =$500). In this example, fifty players rejected the offer (i.e., risked their $10 portion of the award pool) to play a second round. In the second round, forty players make inputs associated with a losing or non-designate outcome. The award portion (e.g., $10) risked by these forty players is forfeited and the value of the award pool (e.g., $500) is divided between the ten remaining eligible players. Thus, each player is associated with an award share equal to $50.

In one embodiment, this offer and acceptance process continues for a designated number of rounds. For example, if this process continues for two rounds, each remaining player (e.g., ten players) in the above example is provided with the award share of $50 after the second round. In another embodiment, this offer and acceptance process continues until a designated number of eligible players remain. For example, if the designated number of players is equal to five players in the above example, the central controller offers the ten players who advanced from the second round to either quit the bonus event and be provided their respective portion of the remaining award pool (e.g., $50) or risk this portion to play a third round. In this example, all ten players reject the offered award portion (e.g., $50) to play the third round. If five players make an input associated with the designated or winning outcome in the third round, each player is provided with their respective portion of the remaining award pool (e.g., $500/5 players=$100). Thus, each of the remaining five players is provided with an award having a value of $100. In one embodiment, the central controller continues to advance any remaining eligible players to a subsequent round until the remaining award pool is provided to one of the remaining eligible players.

Alternatively, the central controller is operable to offer a designated percentage of the award pool in each round. For example, based on an award pool valued at $1000 for a bonus event including five rounds, a first round of the bonus event may be associated with twenty percent of the award pool (e.g., $200). In one embodiment, each round is associated with a different percentage of the award pool. In another embodiment, each round is associated with the same percentage of the award pool. If one hundred players advance from the first round, each of the one hundred players is offered their respective portion ($2) of the award pool (e.g., $200) associated with the first round. In one embodiment, the central controller is operable to provide an offer having a value less than the player's respective portion of the award pool. Based on the above example, the offer may be $1 when the respective portion of the award pool associated with each remaining player is $2. In one embodiment, each advancing player is guaranteed a portion of the award pool for each round, wherein the guaranteed portion of the award pool increases in each round.

In one embodiment, the bonus event is associated with an award pool and at least one portion of the award pool is not provided to the eligible players. For example, a number of eligible players may make inputs associated with a non-designated or losing outcome in a final round of the bonus event. In this instance, the at least one portion of the award pool is provided in a subsequent bonus event (i.e., the remaining portion of the award pool from a first bonus event is rolled into an award pool of a second bonus event). This creates excitement for the players because the award pool of the second bonus event increases.

FIG. 8 is a chart of one embodiment of a multi-round bonus event, wherein a plurality of players compete for an award at substantially the same time and each round is associated with a different additional award. In this embodiment, the multi-round bonus event includes ten rounds. In one embodiment, a first round is associated with a lower award than a higher round. For example, as illustrated, a first round is associated with a $10 award and a ninth round is associated with a $10,000 award. In this embodiment, each player is provided with one of the additional awards for completing a round. That is, if a player completes the first round (i.e., advances from the first round to a second round by making an input associated with a winning outcome in the first round), the central controller provides that player with the additional award (e.g., $10) associated with the first round. If the player completes the ninth round (i.e., advances from the ninth round to a tenth round by making an input associated with a winning outcome in the ninth round), the central controller provides that player with the additional award (e.g., $10,000) associated with the ninth round. In this embodiment, the additional awards accumulate for successful completions of each round and the players do not forfeit or lose the accumulated additional awards when eliminated from the game. In one embodiment, the total award associated with the bonus event funds the accumulated additional awards. In another embodiment, the total award and the accumulated additional awards are predetermined and remain constant for the bonus event. It should be appreciated that the total award and/or one or more of the additional awards may each be funded, at least in part, based on wagers placed on the primary games of the gaming machines in the gaming system, via the gaming establishment or via any suitable manner. For example, the total award and/or one or more additional awards may be funded through player wagers (e.g., a portion of coin-in received by the gaming machines) or by the casino, such as through one or more of the casino's marketing and/or advertising departments.

As illustrated, eight hundred players are eligible for the bonus event in this embodiment. Of the eight hundred eligible players, five hundred players qualified to advance to a second round. The central controller provides these five hundred players with an additional award (e.g., $10) associated with the first round. These five hundred players continue to the second round of the bonus event. The second round of the bonus event is associated with an additional award (e.g., $50). In the second round, two hundred players advance to a third round. The central controller provides these two hundred players with an additional award (e.g., $50) associated with the second round. The second additional award (e.g., $50) is added to the first additional award (e.g., $10) totaling an accumulated additional award (e.g., $60) for these two hundred players. In this embodiment, when a player is eliminated from the bonus event, the central controller provides the player with any accumulated additional awards won during the bonus event. For example, the central controller provides the three hundred players who were eliminated in the second round with the first additional award (e.g., $10).

In one alternative embodiment, the central controller is operable to maintain at least one award pool for each round of the bonus event. The central controller provides a portion of the award pool (or causes a portion of the award pool to be provided) to each player who picked the designated selection in one of the rounds. That is, if a player advances from a first round to a second round, the central controller provides a portion of the award pool associated with the first round to each player who picked the designated selection in the first round. If one player picks the designated selection in one of the rounds, that player is provided with the entire award pool. If a plurality of players pick the designated selection in one of the rounds, those players are provided with respective portions of the award pool (i.e., the award pool is split between these players). In one embodiment, the bonus event is associated with a primary award pool and each round is associated with a secondary award pool. The secondary award pools may collectively form the primary award pool. For example, in a two round bonus event with 10 players, the primary award pool may be $200. In this example, the first and second rounds may each be associated with a portion (e.g., $100) of the primary award pool. Alternatively, a first round may be associated with a lower portion of the award pool than a second round. It should be appreciated that an award pool, as described above, may replace or be used in conjunction with any of the awards or additional awards for the various embodiments disclosed herein.

FIGS. 9A and 9B are charts of one embodiment of a multi-round bonus event, wherein a plurality of players compete for an award at substantially the same time and the award is provided to one or more players in a round that precedes a final round of the bonus event. In this embodiment, the bonus event includes six rounds and is associated with an award of $100,000. The central controller determines that eight hundred players are eligible to compete against one another to win the $100,000 award. Players continue to advance or be eliminated based on their respective input in each round. As illustrated, twenty five players are eligible for a fifth round. Of these players, five players make an input associated with a winning outcome in the fifth round. Accordingly, five players advance to a sixth round, which is the final round of the bonus event in this embodiment. As illustrated in FIG. 9A, the central controller provides each player who completes one of the rounds with an additional award. For each player to complete a round, that player is required to makes an input associated with a winning outcome in the round. The additional awards are each associated with the plurality of rounds, so that one additional award is associated with each round. As illustrated, in a first round, if a player makes an input associated with the winning outcome, the central controller provides that player with an additional award associated with the first round (e.g., $2). In a second round, if a player makes an input associated with the winning outcome, the central controller provides that player with another additional award (e.g., $10). In one embodiment, the additional awards won by the players in the plurality of rounds are accumulated. That is, each player who advances to the third round has won the additional awards associated with the first and second rounds (e.g., $2 and $10 totaling an accumulated additional award, e.g., $12). In one embodiment, if a player is eliminated in the third round (i.e., makes an input associated with a losing outcome in the third round), that player forfeits or loses any accumulated additional awards (e.g., $12) from previous rounds. In another embodiment, the central controller provides the eliminated players with any accumulated additional awards won during previous rounds of the bonus event.

As illustrated in FIG. 9A, five eligible players advanced to the sixth or final round and none of these five players advance (i.e., make an input associated with the winning outcome) in the final round to win the award or a portion of the award. In this embodiment, the central controller designates the players who advanced in the fifth round (i.e., the round immediately preceding the final round) as the winning players as shown in FIG. 9B. That is, the central controller designates the players who advanced to the final round (e.g., from the fifth round) as winning players even though none of these players made inputs associated with the designated outcome (i.e., the winning outcome) in the final round. In this embodiment, each of the five players who advanced to the final round win a portion of the $1,000 award associated with the fifth round (e.g., $200). In the final round, if no players make inputs associated with the designated outcome, the $100,000 award associated with the final round, is provided to the player or players who advanced to the final round (i.e., made inputs associated with the designated outcome in the fifth round). As illustrated in FIG. 9B, each of the players who advanced to the final round are provided a portion of the $100,000 award, such as $20,000 or ⅕ of the $100,000 award. Accordingly, the central controller provides the winning players (or causes the winning players to be provided) with the respective portions (e.g., $20,000) of the total award ($100,000) in addition to the award (e.g., $200) associated with the fifth round. In this embodiment, each player who advanced to the final round is provided with a total award of $20,200.

As described above, the final round is determined to be the round in which one or more players pick a designated outcome. In the above example, the fifth round is determined to be the final round because one or more players pick a designated outcome in the fifth round and none of the players picked a designated outcome is the sixth round. In the above example, the central controller determines the fifth round to be the final round and provides players who picked a designated outcome in the fifth round with the award.

In an alternative embodiment, the final round is dynamically determined based on the number of remaining players in the bonus event. For example, when a designated number of remaining players, such as one, three or any other suitable number of players advance to a given round in the bonus event, the central controller dynamically determines that round to be the final round.

Figure 10:
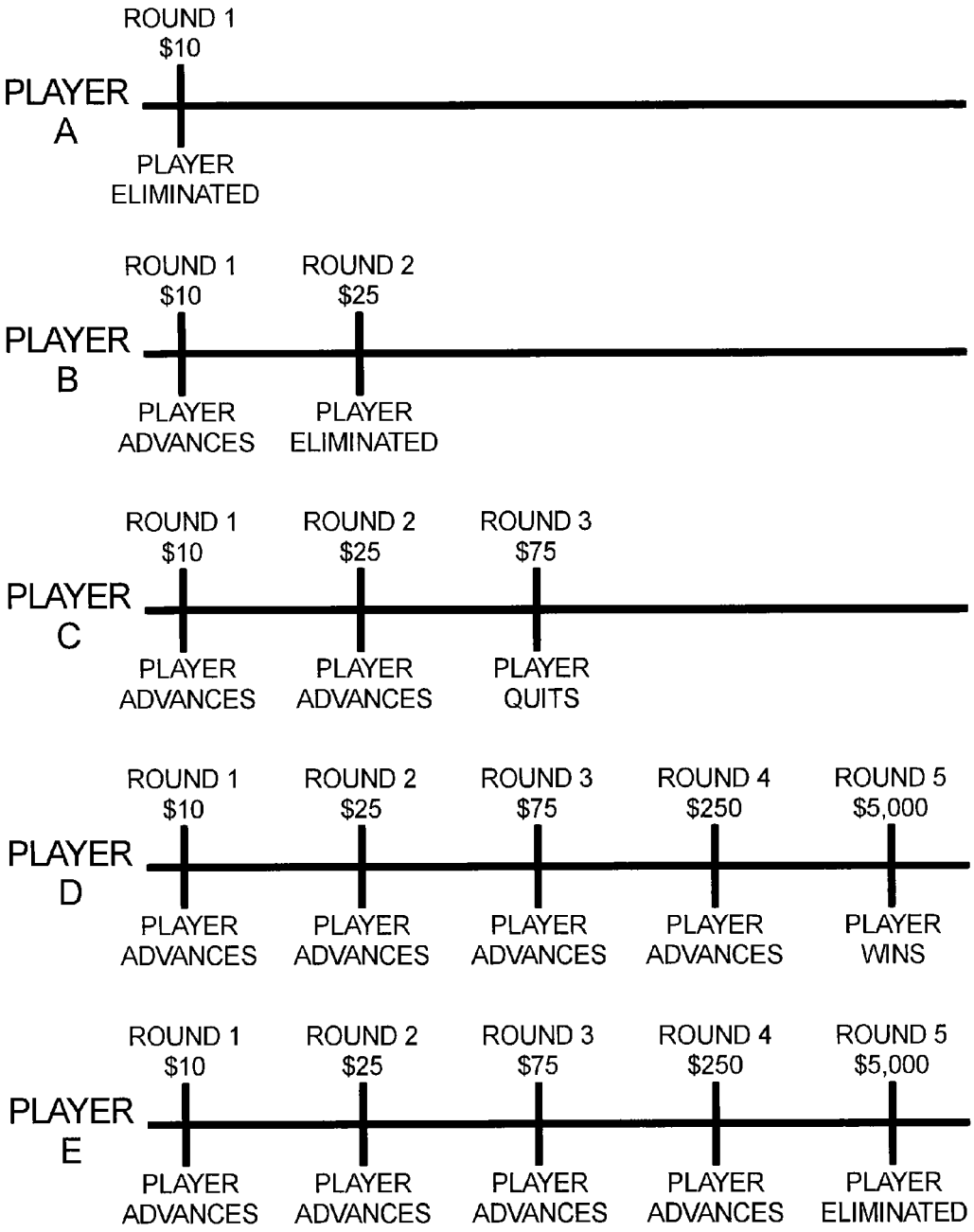
FIG. 10 is a timeline representative of one embodiment of a multi-round bonus event, wherein a plurality of players compete for an award at substantially the same time and the award is provided to at least one of the players.

FIG. 10 is a timeline representative of one embodiment of a multi-round bonus event, wherein a plurality of players compete for an award at substantially the same time and the award is provided to at least one of the players. As illustrated, five players (Players A, B, C, D and E) are eligible for the bonus event which includes five rounds. In this embodiment, the first round is associated with an additional award of $10. That is, the central controller provides the additional award to each player who makes an input associated with the winning outcome in the first round. As illustrated, the second, third, fourth and fifth rounds are associated with additional awards of $25, $75, $250 and $5,000, respectively.

In the first round, the central controller enables Players A, B, C, D and E to make an input. The central controller receives a signal from gaming machines in the gaming system corresponding to an input from Players A, B, C, D and E. Based on the input, the central controller determines whether any of the players will advance to the second round. As illustrated, Player A was eliminated in the first round and Players B, C, D and E advanced to the second round. In one embodiment, the Players B, C, D and E are provided with the additional award associated with the first round. The central controller offers Players B, C, D and E to quit the bonus event prior to the second round. If any of the players quit the bonus event, the central controller provides the additional award associated with the first round (or causes this additional award to be provided) to these players. If the players reject the offer, these players are risking the additional award associated with the first round to play the second round of the bonus event. As illustrated, Players B, C, D and E each rejected the offer and advance to the second round.

For the second round, the central controller enables Players B, C, D and E to make an input. The central controller receives a signal from gaming machines in the gaming system corresponding to an input from Players B, C, D and E. Based on the input, the central controller determines whether any of the players will advance to the third round. As illustrated, Player B was eliminated in the second round and Players C, D and E advanced to the third round. In one embodiment, Player B forfeits or loses the additional award associated with the first round and Players C, D and E have accumulated the additional awards associated with the first and second rounds. The central controller offers Players C, D and E to quit the bonus event prior to the third round. If any of the players quit the bonus event, the central controller provides these players with the accumulated additional awards associated with the first and second rounds. If the players reject the offer, these players are risking the accumulated additional awards associated with the first and second rounds to play the third round of the bonus event. As illustrated, Player C accepts the offer and the central controller provides Player C with the accumulated additional award associated with the first and second rounds (e.g., $10 and $25). Players D and E each rejected the offer and advance to the third round.

For the third and fourth rounds, the central controller enables Players D and E to make an input. The central controller receives a signal from gaming machines in the gaming system corresponding to an input from Players D and E. Based on the input, the central controller determines whether either of the players advance to a subsequent round. As illustrated, Players D and E advanced to the fifth or final round. In the fifth round, the central controller enables Players D and E to make an input. The central controller receives a signal from gaming machines in the gaming system corresponding to an input from Players D and E. Based on the input, the central controller determines whether either of the players win the $5,000 award associated with the final round. As illustrated, Player E was eliminated in the final round (i.e., makes an input associated with a losing outcome) and Player D win the award in the final round (i.e., makes an input associated with a winning outcome). Accordingly, Player E forfeits or loses the accumulated additional awards associated with the first, second, third and fourth rounds. The central controller provides the $5,000 award to Player D and the bonus event ends. In one embodiment, Player D also is provided with the additional awards accumulated by Player D in the bonus event (e.g., $360 or $10+$25+$75+$250).

In one embodiment, the central controller may provide one or more of the players with an anti-terminator to nullify an input associated with a non-designated or losing outcome in a given round. In this embodiment, the anti-terminator provides one of the players with a second opportunity to make an input associated with the designated or winning outcome from the available outcomes in a given round. In another embodiment, the anti-terminator automatically advances one of the players to a subsequent round (i.e., substitutes for a pick of the designated or winning outcome). In one embodiment, the central controller determines when to provide one of the players with an anti-terminator based on: (1) an amount of time the player has played, (2) certain game parameters, such as coin-in or the amount wagered on a game, (3) the player's status as determined through a suitable player tracking system, (4) a separate wager or side wager or (5) any other suitable determining factor. For example, the central controller determines to provide one of the players with an anti-terminator if that player places a separate wager or side wager. Such a configuration enables a player to purchase an anti-terminator by placing a separate wager or side wager. Thus, if the player makes an input associated with a non-designated or losing outcome in a given round, that player may place a separate wager or side wager to buy back into that round of the bonus event. In one embodiment, the central controller limits or caps the number of anti-terminators that each player may purchase in any given round or for each given bonus event.

In one embodiment, the anti-terminator enables a player to accept an offer after the player has picked a losing or non-designated outcome. For example, after advancing to a subsequent round, the central controller provides the player with an offer to quit the bonus event. If the player rejects the offer, the player is advanced to the subsequent round. If the player picks a losing or non-designated outcome in the subsequent round, the central controller enables the player to use an anti-terminator, if available, to accept the previous offer instead of making another selection in the subsequent round. Alternatively, the anti-terminator may enable the player to accept the previous offer or make another selection in the subsequent round.

As described above, the bonus event may be any bonus or secondary game or sequence. For example, in one embodiment illustrated in FIGS. 11A, 11B, 11C, 11D, 11E and 11F, the bonus event includes a selection game that includes a plurality of rounds of game play. FIGS. 11A, 11B, 11C, 11D, 11E and 11F are front views of a display device of a plurality of gaming machines in the gaming system disclosed herein showing the multi-round selection game. Upon an occurrence of a suitable triggering event, the central controller causes the display devices 16*a*, 16*b* and 16*c* to substantially simultaneously display the multi-round selection game to a plurality of eligible players. Five players are eligible for the multi-round selection game and compete for an award, which is illustrated as $10,000. It should be appreciated that FIGS. 11A, 11B and 11C only show a portion of the eligible players (e.g., three players out of five eligible players) and that any suitable number of players may qualify for and be eligible to play the multi-round bonus event.

In one embodiment, the display devices 16*a*, 16*b* and 16*c* simultaneously display each round of the multi-round bonus event to the plurality of eligible players. In an alternative embodiment, the display devices 16*a*, 16*b* and 16*c* sequentially display each round of the multi-round bonus event to a plurality of eligible players at different times. For example, a first round may be provided to the eligible players at a first time and a second round may be provided to any remaining eligible players at a designated time, such as 15 minutes, after completion of the first round. If the first and second rounds are sequentially displayed to the players at different times, the results of the first round (i.e., which players advance to the second round or which players win the award or a portion of the award) may be stored. The central controller is operable to determine a winning player and/or an amount of the award for the second round based on this stored information at a later time, such as 15 minutes after the first round ends. Such a configuration enables players to play the bonus event at different times and may prevent collusion amongst certain players.

It should be appreciated that the display devices 16*a*, 16*b* and 16*c* Illustrate one example of a game play screen for one embodiment of the bonus event described herein. For ease of illustration, the relevant game information for the bonus event is shown on the same display device 16*a*, 16*b* and 16*c* of different gaming machines 10. In alternative embodiments, the relevant game information for the bonus event are divided between different areas of the gaming machine 10 or the display devices 16 and 18. Alternatively, the display device 18 is adapted to display the game play screen.

As illustrated in FIGS. 11A, 11B, 11C, 11D, 11E and 11F, the bonus event is a multi-round selection game that includes a plurality of rounds. In this embodiment, each round includes the plurality of available selections or outcomes 202, 204, 206, 208, 210 and 212. The selections may include any suitable selectable symbols, such as indicia, numbers, colors, letters, playing card ranks, playing card suits, images of people, places or things or any other suitable symbols or images. In one embodiment, the selections are initially masked or hidden from the players. In another embodiment, the selections are different for each player to reduce collusion amongst certain players. For example, for a first player, the designated selection may be a first selection of a plurality of selections and for a second player, the designated selection may be a fifth selection of a plurality of selections.

In each round, the eligible players pick one of the available selections 202, 204, 206, 208, 210 and 212 and the central controller designates one of the available selections 202, 204, 206, 208, 210 and 212 as a designated selection (i.e., winning outcome or selection). In one embodiment, after each eligible player picks one of the selections, the designated selection is revealed to the players. If one of the players picks the designated selection, that player advances to a subsequent round. If one of the players picks one of the selections other than the designated selection (i.e., a losing outcome or selection), that player is eliminated from the bonus event.

Figure 11A:
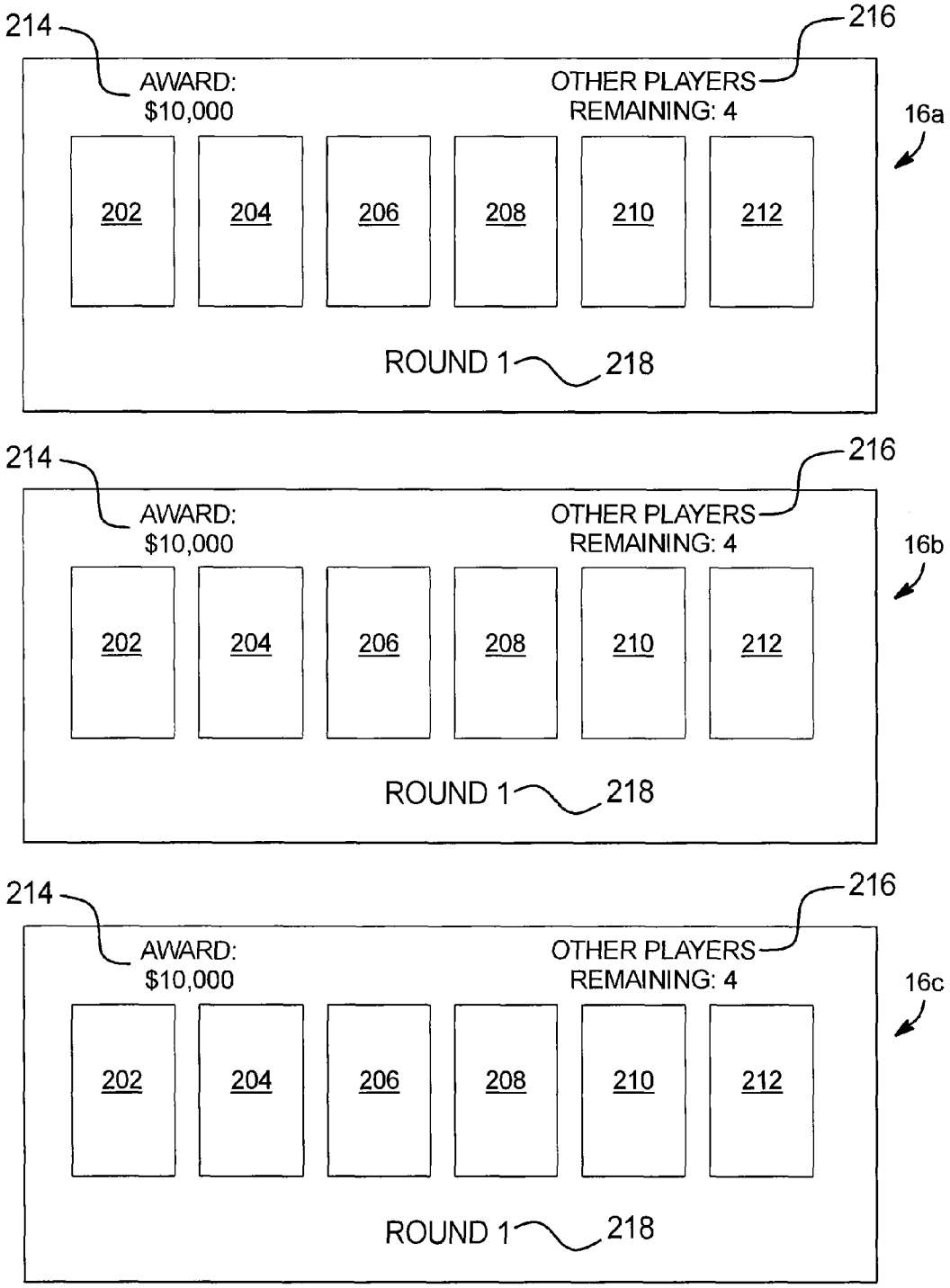
FIGS. 11A, 11B, 11C, 11D, 11E and 11F are front views of a display device of a plurality of gaming machines in the gaming system disclosed herein illustrating one embodiment of a multi-round bonus event, wherein the display devices substantially simultaneously display the bonus event to a plurality of players who compete for an award.

FIG. 11A illustrates the display devices 16*a*, 16*b* and 16*c* of respective gaming machines substantially simultaneously displaying the selections 202, 204, 206, 208, 210 and 212 for a first round of the bonus event. The central controller enables each player to select at least one of the selections via any suitable input device of the gaming machine, such as a touch screen. For example, a first player (e.g., Player A) selects from among the selections displayed on the display device 16*a*, a second player (e.g., Player B) selects from among the selections displayed on the display device 16*b*, and a third player (e.g., Player C) selects from among the selections displayed on the display device 16*c*. In one embodiment, the display devices 16*a*, 16*b* and 16*c* display the same selections to each eligible player. Alternatively, the display devices 16*a*, 16*b* and 16*c* may display different selections, different numbers of selections and/or different numbers of designated selections based on any suitable criteria. Such criteria include (1) an amount of time the player has played, (2) certain game parameters, such as coin-in or the amount wagered on a game, (3) the player's status as determined through a suitable player tracking system, or (4) any other suitable determining factor. By providing different selections to different players, the implementer or operator of the gaming system can reduce collusion amongst certain players. In one instance, for a first player, the designated selection may be a first selection of a plurality of selections and for a second player, the designated selection may be a fifth selection of a plurality of selections.

Each display device 16*a*, 16*b* and 16*c* displays a status of the bonus event. As illustrated, the status of the bonus event displayed on the display devices 16*a*, 16*b* and 16*c* is identical. The status of the bonus event is represented by an award associated with the bonus event, a number of eligible players in the bonus event and a round of the bonus event. As illustrated, the amount of the award is $10,000, which is indicated by an award display 214. Each display device 16*a*, 16*b* and 16*c* may include a dynamically updating other players remaining display 216 to indicate the number of remaining eligible players (other than the current player) in the bonus event. For instance, for Player A, the other players remaining display 216 indicates that four other players remain in the bonus event (e.g., Player B, Player C and two other players not shown). Thus, the total number of eligible players in the bonus event equals five players (e.g., Player A, Player B, Player C and two other players not shown). Alternatively, the other remaining players display 216 could display or indicate all of the eligible players remaining in the bonus event.

In one embodiment, a potential award associated with each eligible player is $2,000, which may be indicated by a potential award display (not shown) is also displayed. In one such embodiment, the award share represents a portion of the award attributed to each player remaining in the bonus event. In this instance, the award share is equal to the amount of the award associated with the bonus event divided by the number of eligible players in the bonus event, which results in an equal award share being associated with each eligible player. In another embodiment, the award share associated with each eligible player is based on the amount of the award and some other factor, such as a player status (as determined through a suitable player tracking system). Such a configuration may result in each eligible player being associated with a disproportionate share of the award. A round display 218 indicates a current round of the bonus event.

Figure 11B:
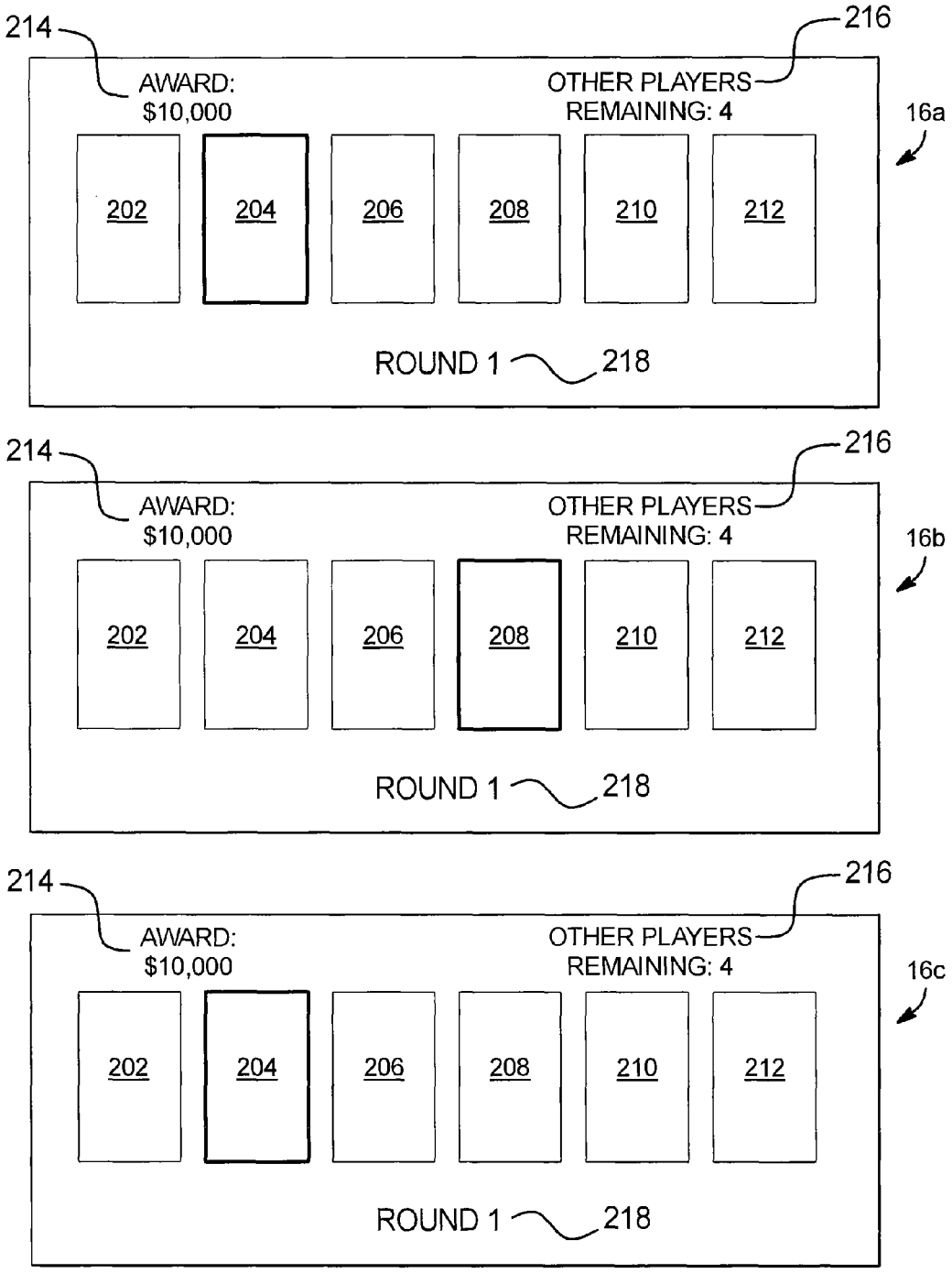

In FIG. 11B, the display devices 16*a*, 16*b* and 16*c* display the respective player picks of the selections 202, 204, 206, 208, 210 and 212 for the first round of the bonus event. Player A picked the selection 204 as indicated by the display device 16*a*. Player B picked the selection 208 as indicated by the display device 16*b*. Player C picked the selection 204 as indicated by the display device 16*c*. In this embodiment, each player picked one of the selections 202, 204, 206, 208, 210 and 212, such as through input devices associated with gaming machines in the gaming system, in an attempt to advance to a second round.

Figure 11C:
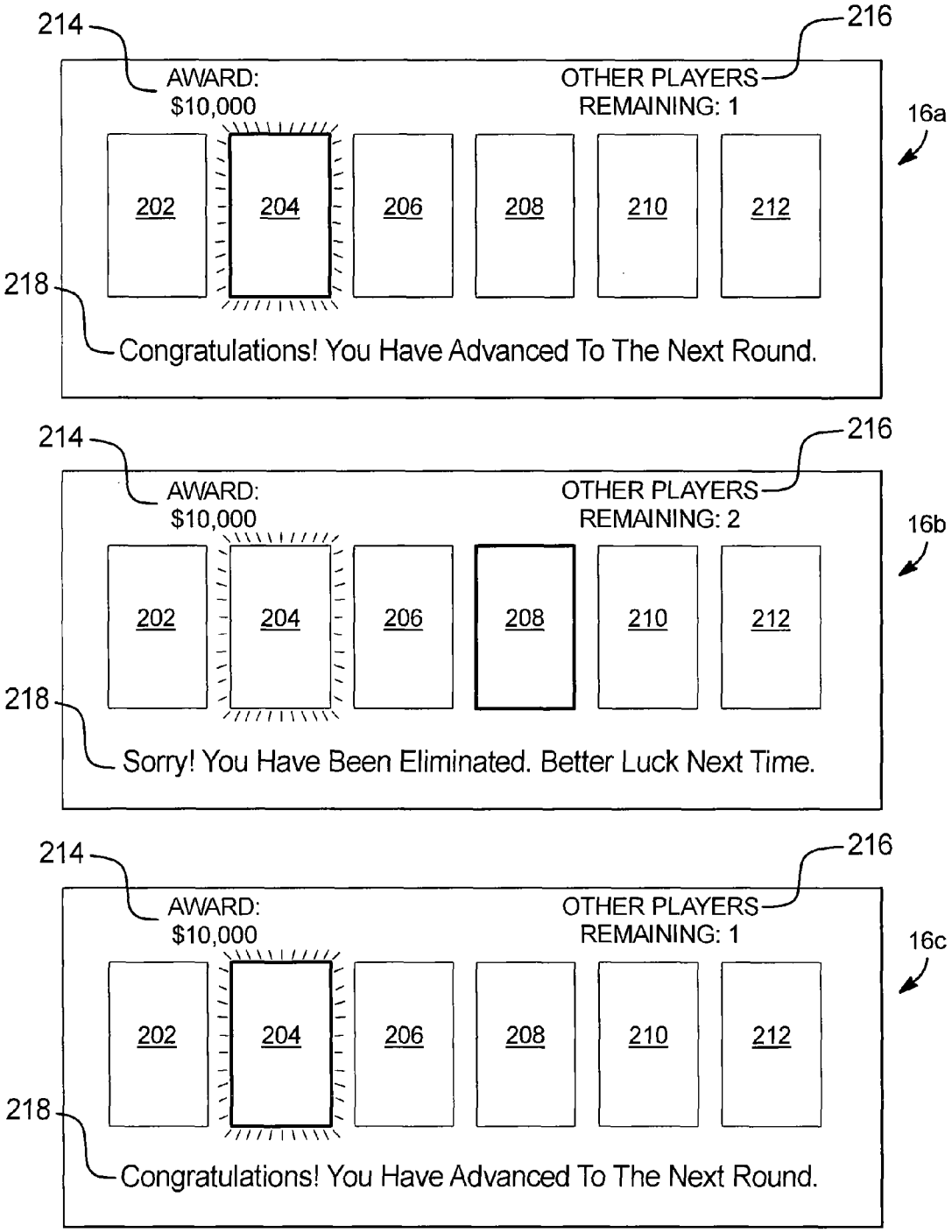

As illustrated in FIG. 11C, the central controller designated the selection 204 as the designated selection. The central controller causes the display device 16*a*, 16*b* or 16*c* to indicate the designated selection through illumination, highlighting, audio and/or visual effects. Such illumination, highlighting or audio and/or visual effects help the players determine the designated selection. This designation may be random, predetermined or based on any other suitable factor. In one embodiment, at least one of the selections 202, 204, 206, 208, 210 and 212 are weighted so that the central controller designates this selection more often than another one of the selections. In one embodiment, a plurality of selections are designated as a winning selection for one or more of the rounds. By designating a plurality of winning selections, the implementer or operator of the gaming system can control the odds of advancing into each round and/or winning an award in the bonus event. Additionally, the number of winning selections in each round at least partially determines the difficulty of the round. By having a plurality of winning selections in a first round, players have a better chance or likelihood of advancing to a subsequent round. The implementer or operator of the gaming system can adjust the difficulty of the rounds by changing the number of winning selections in each round and the number of available selections in each round. This makes the bonus event (e.g., the elimination sequence) more exciting for players as the players are less likely to be eliminated in rounds with a high number of winning selections and/or rounds with a relatively low number of available selections.

In one embodiment, the number of designated selections and/or the number of available selections is based on a wager amount placed by the player on the primary game. In one embodiment, if a player places a high wager amount on the primary game, such as a max wager level or maximum wager, that player is provided with a high number of designated selections in the bonus event. Accordingly, if that player places a low wager amount in the primary game, that player is provided with a low number of designated selections in the bonus event. Similarly, in another embodiment, if a player places a high wager amount on the primary game, such as a max wager level or maximum wager, that player is provided with a low number of available selections. Accordingly, if that player places a low wager amount in the primary game, that player is provided with a high number of available selections in the bonus event.

In one embodiment, the central controller is programmed to indicate the designated selection after each eligible player has picked one of the selections 202, 204, 206, 208, 210 and 212. This ensures that the designated selection is not revealed to the eligible players prior to those players making their picks of the available selections and substantially reduces collusion amongst certain players.

The central controller determines whether any of the Players A, B or C picked the designated selection 204 to advance to the second round. As illustrated, Player A and Player C picked the designated selection 204, which is shown illuminated in FIG. 11C. Player B picked a non-designated selection. Accordingly, Player A and Player C advance to a second round of the bonus event while Player B is eliminated from the bonus event. The display devices 16*a*, 16*b* and 16*c* may indicate each player's advancement or elimination through appropriate messaging provided to the players visually, or through suitable audio or audiovisual displays. Such messages include "CONGRATULATIONS! YOU HAVE ADVANCED TO THE NEXT ROUND." or "SORRY! YOU HAVE BEEN ELIMINATED. BETTER LUCK NEXT TIME." As illustrated, the round display 218 displays such messages although a separate display area of the display devices 16*a*, 16*b* and 16*c* may be used.

The central controller updates the other players remaining display 216 of the display devices 16*a*, 16*b* and 16*c*. The other players remaining display on the display devices 16*a* and 16*c* show that one other player (i.e., Player A or Player C) remain in the bonus event. The other players remaining display on the display device 16*b* shows that two other player (i.e., Player A and Player C) remain in the bonus event. The potential award for Player B is $0 because Player B was eliminated in the round. Accordingly, the potential award for Players A and C increases to $5,000. The potential award for Player A and Player C increased as a result of Player B being eliminated. Player A and Player C are still eligible to win the $5,000 award in the bonus event and the central controller causes the display devices 16*a* and 16*c* to display a second round of the bonus event. In one embodiment, the display device 16*b* also displays the second round of the bonus event, but with the plurality of selections disabled so that Player B cannot make a pick of the selections. In this embodiment, Player B can follow any subsequent rounds of the bonus event without actually participating in those subsequent rounds.

Figure 11D:
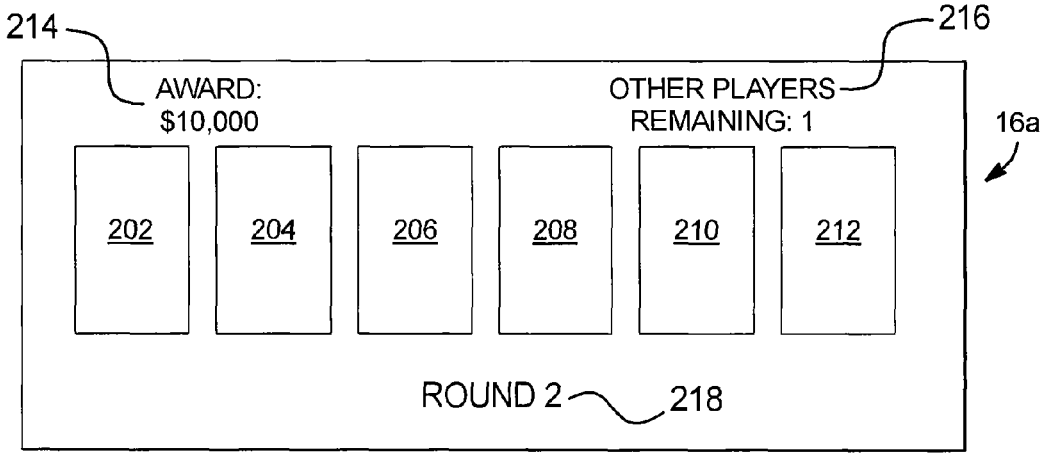
Figure 11D:
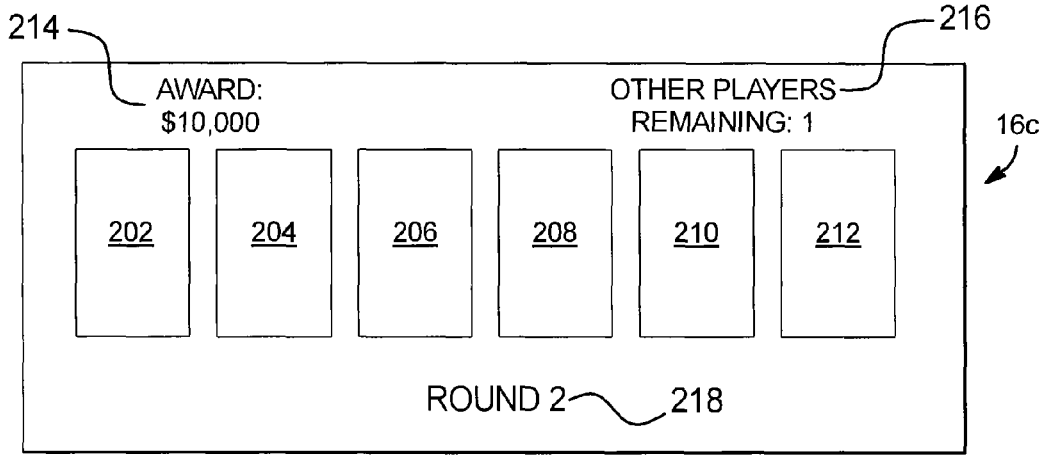

In FIG. 11D, the display devices 16*a* and 16*c* each display the selections 202, 204, 206, 208, 210 and 212 for the second round of the bonus event. The round display 218 indicates the second round of the bonus event. The award display 214 indicates that the award equals $10,000 and the other players remaining display 216 indicates that one other player remains the bonus event. For instance, for player A, the display device 16*a* indicates that one other player (i.e., Player C) remains in the bonus event. The central controller enables Player A and Player C to select at least one of the selections 202, 204, 206, 208, 210 and 212 in the second round, such as through input devices of the gaming machines in the gaming system.

Figure 11E:
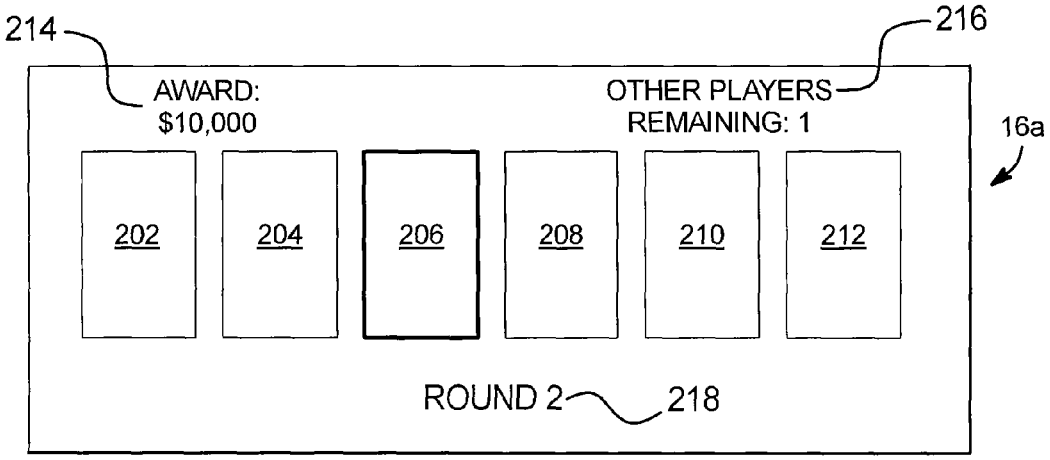
Figure 11E:
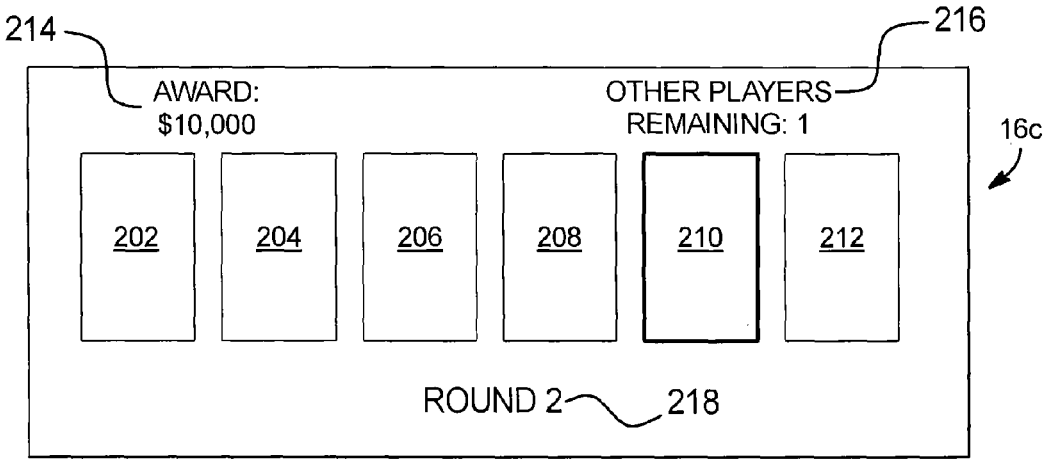

As illustrated in FIG. 11E, the display devices 16*a*, 16*b* and 16*c* display the respective player picks of the selections 202, 204, 206, 208, 210 and 212 for the second round of the bonus event. Player A picked the selection 206 as indicated by the display device 16*a* and Player C picked the selection 210 as indicated by the display device 16*c*.

Figure 11F:
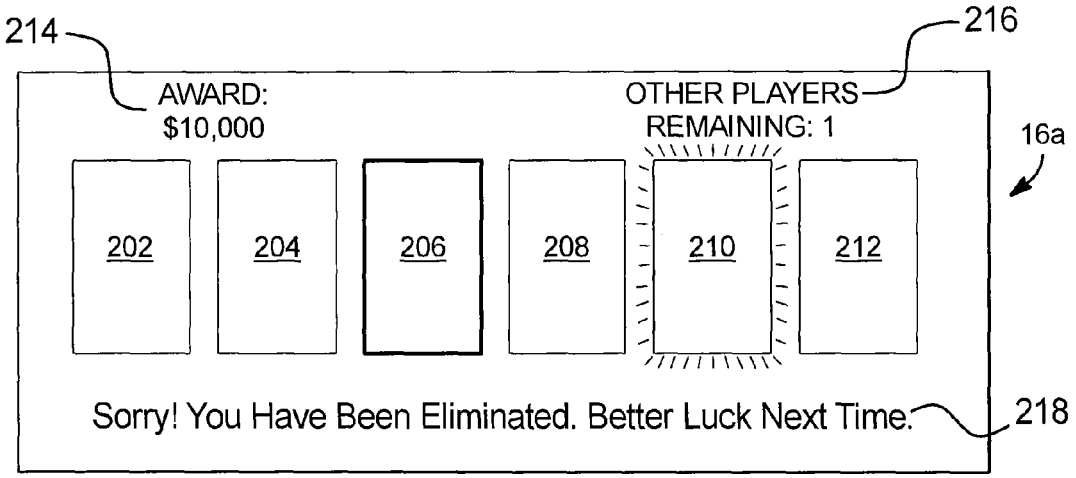
Figure 11F:
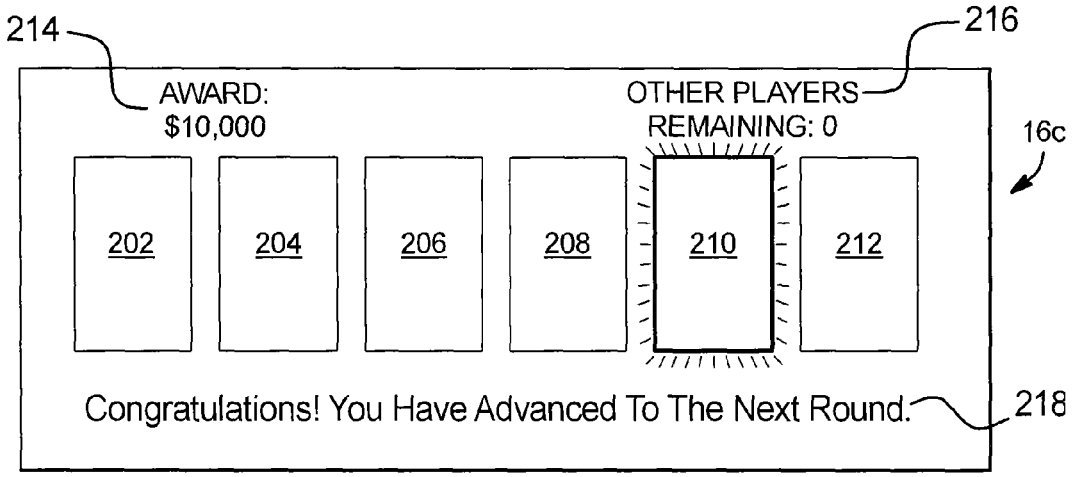

In FIG. 11F, the central controller designated the selection 210 as the designated selection. The designated selection 210 is illuminated as indicated on the display devices 16*a* and 16*c*. The central controller determines whether Player A or Player C picked the designated selection 210. As illustrated, Player A picked a non-designated selection 206 while Player C picked the designated selection 210. Accordingly, Player C wins the award (i.e., $10,000) of the bonus event while Player A is eliminated from the bonus event. As described above, appropriate messaging may be provided to the players visually, or through suitable audio or audiovisual displays. Such messages include "CONGRATULATIONS! YOU HAVE WON $10,000." or "SORRY! YOU HAVE BEEN ELIMINATED. BETTER LUCK NEXT TIME." As illustrated, the round display 218 displays such messages although a separate display area of the display devices 16*a*, 16*b* and 16*c* may be used.

The central controller updates the other players remaining display 216 of the display devices 16*a* and 16*c*. The player remaining display on the display devices 16*a* shows that one other player remains in the bonus event (i.e., Player C). The player remaining display on the display devices 16*c* shows that no other players remain in the bonus event (i.e., because Player A was eliminated in this round). The central controller provides Player C with the $10,000 award. Player C was provided with the entire award as a result of Player A being eliminated in the round. After the central controller provides the award to Player C, the bonus event ends.

In one embodiment, the bonus event ends after a designated number of rounds including a final round. In another embodiment, the bonus event ends when a designated number of eligible players remain in the bonus event. In another embodiment, the bonus event ends when the central controller provides the award (or a portion of the award) to the determined winning player or players. In another embodiment, the bonus event ends if when none of the players pick the designated selection (or make an input associated with a designated outcome, such as a winning outcome) in one of the rounds.

It should be appreciated that the number of selections in each round, the number of rounds and the number of designated selections in each round may be set by the game implementer to any suitable numbers. In one embodiment, the number of selections increases for each round in the bonus event so that a first round has fewer selections than any subsequent round. These parameters help the game implementer to control the odds of the bonus event. For example, if the bonus event includes six selections per round, each player has a lower chance of picking the designated selection than if the bonus event includes four selections per round. Accordingly, a lower number of players (on average) will advance through each round if each round includes a high number of selections. Similarly, if the bonus event includes ten rounds, each player has a lower chance of advancing to a final round than if the bonus event includes four rounds. Accordingly, a lower number of players (on average) will advance to the final round if each bonus event includes a high number of rounds.

In one embodiment, the number of selections in each round, the number of rounds and the number of designated selections in each round may be based on: (1) an amount of time the player has played, (2) certain game parameters, such as coin-in or the amount wagered on a game, (3) the player's status as determined through a suitable player tracking system, or (4) any other suitable determining factor. In one embodiment, a player with a high status (e.g., platinum status) starts the bonus event at a third round while a player with a low status (e.g., bronze status) starts the bonus event at a first round. In this embodiment, players with a high status received a free pass for the first two rounds of the bonus event and start in the third round.

In one embodiment, the central controller is operable to adjust the difficulty of the bonus event and/or the difficulty of one or more rounds of the bonus event. The difficulty is at least partially based on the number of designated outcomes in each round and the number of available outcomes in each round. For example, in a round that includes ten available outcomes and one designated outcome, about 10% of players who participate in the round will make an input associated with the designated outcome. If that same round includes ten available outcomes and five designated outcomes, about 50% of players who participate in the round will make an input associated with the designated outcome. Similarly, for a round that includes two available outcomes and one designated outcome, about 50% of players who participate in the round will make an input associated with the designated outcome. In one embodiment, a first round is associated with a low difficulty (e.g., a low number of available outcomes and/or a high number of designated outcomes) while a second, different round is associated with a higher relative difficulty (e.g., a higher relative number of available outcomes and/or a lower relative number of designated outcomes) than the first round. In one embodiment, the difficulty of each round increases as the bonus event progresses.

In one embodiment, the central controller is operable to provide hints to the players to decrease the difficulty level in one or more rounds. For example, each hint may include an indication of the designated outcome in a given round. In another example, each hint may include a removal of a designated number of available outcomes in a given round. In one embodiment, the central controller is operable to enable players to purchase one or more of such hints to decrease the difficulty level of a given round of the bonus event. The amount paid by a player determines the difficulty level of the given round, wherein a higher amount paid may decrease the difficulty level more than a lower amount. In one embodiment, the central controller enables the player to purchase different hints for different wager amounts, wherein such hints may decrease the number of available outcomes and/or increase the number of designated outcomes in a given round. In one such embodiment, hints associated with higher wager amounts decrease the number of available outcomes and/or increase the number of designated outcomes in a given round by greater amounts than hints associated with lower wager amounts. For example, a first round of the bonus event may include seven available outcomes. If the player does not purchase a hint, the first round includes seven available outcomes. If the player purchases a hint for $1, the number of available selections in the first round is reduced to five available outcomes (e.g., two available outcomes are removed or eliminated from the first round). If the player purchases a hint for $5, the number of available selections in the first round is reduced to two available outcomes (e.g., five available outcomes are removed or eliminated from the first round).

In one embodiment, each round is timed so that each eligible player has a predetermined amount of time, such as 60 seconds, to make an input. In one embodiment, if the player does not make an input in the predetermined amount of time, the player is deemed ineligible and eliminated from the bonus event. In another embodiment, if the player does not make an input in the predetermined amount of time, the central controller randomly selects the input for the player.

In one embodiment, a designated award, such as a top-level award or an award of relatively high value, is unavailable until a predetermined criteria is met. Such predetermined criteria include (1) play of the bonus event, such as advancement to a certain round in the bonus event, (2) an amount of time the player has played, (3) certain game parameters, such as coin-in or the amount wagered on a game, (4) the player's status as determined through a suitable player tracking system, or (5) any other suitable determining factor. In this embodiment, eligible players cannot play for the unavailable designated award until the predetermined criteria is met.

It should be understood that various changes and modifications to the presently preferred embodiments described herein will be apparent to those skilled in the art. For example, the gaming system disclosed herein may provide the awards to winning players in any suitable manner, such as through a suitable bonus or secondary game or event determined by the implementer or operator of the gaming system. The implementer or operator of the gaming system disclosed herein may also designate the number of awards, the time at which those awards are provided to each winning player, the number of rounds in the bonus event, the number of designated outcomes in each round and/or the number of available outcomes in each round to suitable values. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a plurality of gaming machines, each gaming machine including:

at least one input device, at least one display device, at least one processor, and at least one memory device which stores a plurality of instructions, which when executed by the at least one processor, cause the at least one processor to operate with the at least one display device and the at least one input device to display a primary game to a player upon a placement of a wager; and a controller configured to communicate with the plurality of gaming machines, said controller programmed to, upon an occurrence of a triggering event:

(a) initiate a bonus event having a plurality of sequential rounds including an initial round and a final round, each round associated with at least one winning outcome and at least one losing outcome, wherein each of the players of each of the gaming machines are designated as eligible for the initial round;

(b) for each sequential round until the final round:

(i) enable each eligible player to make an input associated with said round of the bonus event, and (ii) for each eligible player:

(A) if the player's input associated with that round of the bonus event is associated with the winning outcome of that round of the bonus event:

(I) cause a designation that the player is eligible to advance to another round of the bonus event, and (II) associate an award for said round with the player, wherein:

(1) if none of the players make inputs associated with the winning outcome in any immediately subsequent round, the award for said round associated with the player is provided to the player, and (2) if at least one of the players makes at least one input associated with the winning outcome in any immediately subsequent round, the award for said round associated with the player is not provided to the player in association with the player's input associated with that round of the bonus event; and (B) if the player's input associated with that round of the bonus event is associated with the losing outcome of that round of the bonus event, cause a designation that the player is ineligible to advance to another round of the bonus event; and (c) for the final round of the bonus event:

(i) enable each eligible player to make an input associated with said final round of the bonus event, and (ii) for each eligible player:

(A) if the player's input associated with the final round of the bonus event is associated with the winning outcome of the final round, provide said player with a final round award, and (B) if the player's input associated with the final round of the bonus event is associated with the losing outcome of the final round, do not provide said final round award to the player.

2. The gaming system of claim 1, wherein the triggering event is based on at least one displayed event in the play of the primary game of one of the gaming devices.

3. The gaming system of claim 1, wherein the triggering event is independent of any displayed event in any play of any primary game or of any plays of any secondary game of the gaming devices.

4. The gaming system of claim 1, wherein the controller is programmed to cause the eligible gaming machines to substantially simultaneously provide the bonus event to the players.

5. The gaming system of claim 1, wherein the controller is programmed to cause the eligible gaming machines to sequentially provide the bonus event to the players at different times.

6. The gaming system of claim 1, wherein for the final round, when a plurality of the eligible players each make a designated input that is associated with the winning outcome, the controller is programmed to provide each of said plurality of eligible players with a portion of the final round award.

7. The gaming system of claim 1, wherein the bonus event is a selection game including a plurality of selections associated with each round and the controller designates at least one of the selections as the winning outcome and at least one of the selections as the losing outcome.

8. The gaming system of claim 7, wherein the controller is programmed to enable the eligible players to pick from a plurality of the selections in each round.

9. The gaming system of claim 1, wherein if none of the eligible players make inputs associated with the winning outcome in none of the rounds, the controller is programmed to provide at least one of the awards in a different bonus event having a plurality of sequential rounds including an initial round and a final round.

10. The gaming system of claim 9, wherein the controller is programmed to change the odds of winning the at least one of the awards in the different bonus event.

11. The gaming system of claim 9, wherein the bonus event is associated with a first bonus qualification period and the different bonus event is associated with a second bonus qualification period and wherein the second bonus qualification period is shorter than the first bonus event qualification period.

12. The gaming system of claim 1, wherein, if one of the eligible players makes a designated input that is associated with the losing outcome, the controller is programmed to enable said player to make another input in the round.

13. The gaming system of claim 1, wherein the controller is programmed to accumulate the awards provided to each eligible player in the plurality of rounds.

14. The gaming device of claim 13, wherein any accumulated awards provided to the eligible player if the eligible player makes an input associated with the winning outcome in one of the rounds are forfeited if the player is eliminated from a subsequent round.

15. The gaming system of claim 1, wherein the controller is programmed to provide an additional award to each eligible player who made an input associated with the winning outcome in each round.

16. The gaming system of claim 1, wherein after each round, the controller is programmed to make an offer to each eligible player who made an input associated with the winning outcome in the round, the offer including either an additional award to quit the bonus event or another round to continue playing the bonus event.

17. The gaming system of claim 16, wherein, if the player quits the bonus event, the controller provides the additional award to the player.

18. A method of providing a multiple round bonus event, said method comprising:

(a) causing a plurality of display devices of a plurality of devices to each display a primary game to a player upon a placement of a wager; and (b) upon an occurrence of a triggering event:

(i) causing at least one controller to initiate a bonus event having a plurality of sequential rounds including an initial round and a final round, each round associated with at least one winning outcome and at least one losing outcome, wherein each of the players of each of the devices are designated as eligible for the initial round;

(ii) for each sequential round until the final round:

(A) enabling each eligible player to make an input associated with said round of the bonus event, and (B) for each eligible player:

(I) if the player's input associated with that round of the bonus event is associated with the winning outcome of that round of the bonus event:

(1) causing the at least one controller to cause a designation that the player is eligible to advance to another round of the bonus event, and (2) causing the at least one controller to associate an award for said round with the player, wherein:

(x) if none of the players make inputs associated with the winning outcome in any immediately subsequent round, the award for said round associated with the player is provided to the player, and (y) if at least one of the players makes at least one input associated with the winning outcome in any immediately subsequent round, the award for said round associated with the player is not provided to the player in association with the player's input associated with that round of the bonus event; and (II) if the player's input associated with that round of the bonus event is associated with the losing outcome of that round of the bonus event, causing the at least one controller to cause a designation that the player is ineligible to advance to another round of the bonus event; and (iii) for the final round of the bonus event:

(A) enabling each eligible player to make an input associated with said final round of the bonus event, and (B) for each eligible player:

(I) if the player's input associated with the final round of the bonus event is associated with the winning outcome of the final round, providing said player with a final round award, and (II) if the player's input associated with the final round of the bonus event is associated with the losing outcome of the final round, not providing said final round award to the player.

19. The method of claim 18, wherein the triggering event is based on at least one displayed event in the play of the primary game displayed by one of the display devices.

20. The method of claim 18, wherein the triggering event is independent of any displayed event in any play of any primary game or of any plays of any secondary game displayed by the display devices.

21. The method of claim 18, which includes causing the at least one controller to cause the eligible devices to substantially simultaneously provide the bonus event to the players.

22. The method of claim 18, which includes causing the at least one controller to cause the eligible devices to sequentially provide the bonus event to the players at different times.

23. The method of claim 18, which includes, for the final round, when a plurality of the eligible players each make a designated input that is associated with the winning outcome, providing each of said plurality of eligible players with a portion of the final round award.

24. The method of claim 18, wherein the bonus event is a selection game including a plurality of selections associated with each round and which includes causing the at least one controller to designate at least one of the selections as the winning outcome and at least one of the selections as the losing outcome.

25. The method of claim 24, which includes enabling the eligible players to pick from a plurality of the selections in each round.

26. The method of claim 18, which includes, if none of the eligible players make inputs associated with the winning outcome in none of the rounds, providing at least one of the awards in a different bonus event having a plurality of sequential rounds including an initial round and a final round.

27. The method of claim 26, which includes causing the at least one controller to change the odds of winning the at least one of the awards in the different bonus event.

28. The method of claim 26, wherein the bonus event is associated with a first bonus qualification period and the different bonus event is associated with a second bonus qualification period and wherein the second bonus qualification period is shorter than the first bonus event qualification period.

29. The method of claim 18, which includes, if one of the eligible players makes a designated input that is associated with the losing outcome, causing the at least one controller to enable said player to make another input in the round.

30. The method of claim 18, which includes causing the at least one controller to accumulate the awards provided to each eligible player in the plurality of rounds.

31. The method of claim 30, wherein any accumulated awards provided to the eligible player if the eligible player makes an input associated with the winning outcome in one of the rounds are forfeited if the player is eliminated from a subsequent round.

32. The method of claim 18, which includes providing an additional award to each eligible player who made an input associated with the winning outcome in each round.

33. The method of claim 18, which includes, after each round, causing the at least one controller to make an offer to each eligible player who made an input associated with the winning outcome in the round, the offer including either an additional award to quit the bonus event or another round to continue playing the bonus event.

34. The method of claim 33, wherein, if the player quits the bonus event, the controller provides the additional award to the player.

35. The method of claim 18, which is provided through a data network.

36. The method of claim 35, wherein the data network is the internet.

* * * * *

UNITED STATES PATENT AND TRADEMARK OFFICE

CERTIFICATE OF CORRECTION

PATENT NO. : 8,105,149 B2
APPLICATION NO. : 11/558683
DATED : January 31, 2012
INVENTOR(S) : Daniel DeWaal It is certified that error appears in the above-identified patent and that said Letters Patent is hereby corrected as shown below:

IN THE CLAIMS:

In Claim 1, Column 46, Line 22, replace “are” with --is--.

In Claim 1, Column 46, Line 29, between “the” and “winning” insert --at least one--.

In Claim 1, Column 46, Line 37, between “the” and “winning” insert --at least one--.

In Claim 1, Column 46, Line 42, between “the” and “winning” insert --at least one--.

In Claim 1, Column 46, Line 49, between “the” and “losing” insert --at least one--.

In Claim 1, Column 46, Line 59, before “winning” insert --at least one--.

In Claim 1, Column 46, Line 63, before “losing” insert --at least one--.

In Claim 6, Column 47, Line 15, between “the” and “winning” insert --at least one--.

In Claim 7, Column 47, Line 21, between “the” and “winning” insert --at least one--.

In Claim 7, Column 47, Line 22, between “the” and “losing” insert --at least one--.

In Claim 9, Column 47, Line 27, between “the” and “winning” insert --at least one--.

In Claim 10, Column 47, Line 33, delete the first instance of “the.”.

In Claim 12, Column 47, Line 43, between “the” and “losing” insert --at least one--.

In Claim 14, Column 47, Line 50, between “the” and “winning” insert --at least one--.

In Claim 15, Column 47, Line 55, between “the” and “winning” insert --at least one--.

In Claim 16, Column 47, Lines 59 to 60, between “the” and “winning” insert --at least one--.

In Claim 18, Column 48, Line 10, replace “are” with --is--.

In Claim 18, Column 48, Line 17, between “the” and “winning” insert --at least one--.

In Claim 18, Column 48, Line 25, between “the” and “winning” insert --at least one--.

In Claim 18, Column 48, Line 30, between “the” and “winning” insert --at least one--.

In Claim 18, Column 48, Line 37, between “the” and “losing” insert --at least one--.

In Claim 18, Column 48, Line 49, before “winning” insert --at least one--.

Signed and Sealed this
Eighth Day of May, 2012

David J. Kappos

David J. Kappos
*Director of the United States Patent and Trademark Office*

In Claim 18, Column 48, Line 53, before “losing” insert --at least one--.

In Claim 23, Column 49, Line 3, between “the” and “winning” insert --at least one--.

In Claim 24, Column 49, Line 10, before “winning” insert --at least one--.

In Claim 24, Column 49, Line 11, before “losing” insert --at least one--.

In Claim 27, Column 49, Line 22, delete the first instance of “the.”.

In Claim 29, Column 50, Line 3, between “the” and “losing” insert --at least one--.

In Claim 31, Column 50, Line 10, between “the” and “winning” insert --at least one--.

In Claim 32, Column 50, Line 15, between “the” and “winning” insert --at least one--.

In Claim 33, Column 50, Line 19, before “winning” insert --at least one--.